US011697886B2

(12) United States Patent
Miyamoto

(10) Patent No.: US 11,697,886 B2
(45) Date of Patent: Jul. 11, 2023

(54) SUBSTRATE HOLDER

(71) Applicant: EBARA CORPORATION, Tokyo (JP)

(72) Inventor: Matsutaro Miyamoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 216 days.

(21) Appl. No.: 17/117,804

(22) Filed: Dec. 10, 2020

(65) Prior Publication Data

US 2021/0180205 A1 Jun. 17, 2021

(30) Foreign Application Priority Data

Dec. 13, 2019 (JP) ..... 2019-225777

(51) Int. Cl.
*C25D 17/06* (2006.01)
*C25D 17/00* (2006.01)

(52) U.S. Cl.
CPC ..... *C25D 17/06* (2013.01); *C25D 17/001* (2013.01); *C25D 17/004* (2013.01); *C25D 17/005* (2013.01)

(58) Field of Classification Search
None
See application file for complete search history.

(56) References Cited

U.S. PATENT DOCUMENTS

| | | | | |
|---|---|---|---|---|
| 2018/0182659 | A1* | 6/2018 | Yokoyama | C25D 17/06 |
| 2020/0199770 | A1 | 6/2020 | Moriyama et al. | |
| 2020/0248331 | A1* | 8/2020 | Okuda | H01L 21/67346 |
| 2021/0123154 | A1* | 4/2021 | Iou | C25D 17/08 |

FOREIGN PATENT DOCUMENTS

| | | | |
|---|---|---|---|
| JP | 2007-046154 | A | 2/2007 |
| JP | 2008-133526 | A | 6/2008 |
| JP | 2018-040045 | A | 3/2018 |
| JP | 2019-007075 | A | 1/2019 |

* cited by examiner

*Primary Examiner* — Louis J Rufo
(74) *Attorney, Agent, or Firm* — BakerHostetler

(57) ABSTRACT

There is provided a substrate holder. The substrate holder comprises a contact assembly; a first plate configured to hold a substrate between the contact assembly and the first plate; at least one first pin fixed to the contact assembly, extended toward a first plate side on outside of the substrate, and provided with a locked portion; a locking member placed on a side opposite to the contact assembly relative to the first plate and configured to be displaceable between a locked state and an unlocked state with respect to the locked portion of the first pin; and at least one first biasing member placed between the locking member and the first plate along an outer circumferential part of the substrate such as to separate the locking member and the first plate from each other and compressed between the locking member and the first plate in the locked state to bias the first plate toward the contact assembly.

20 Claims, 26 Drawing Sheets

SUBSTRATE HOLDER

TECHNICAL FIELD

The present disclosure relates to a substrate holder configured to hold a substrate.

BACKGROUND ART

A general procedure forms wirings, bumps (salient electrodes) and the like on the surface of a substrate such as a semiconductor wafer or a printed circuit board. An electroplating technique is known as a method of forming such wirings, bumps and the like. A plating apparatus employed for the electroplating technique is provided with a substrate holder that is configured to seal an end face of a circular or polygonal substrate and hold the substrate with a surface to be plated (a plating surface) of the substrate exposed. A procedure of plating the surface of a substrate by such a plating apparatus soaks the substrate holder with the substrate held thereby into a plating solution.

A substrate holder suitable for a large-sized, especially rectangular substrate has been known as described in Japanese Unexamined Patent Publication No. 2018-40045 (Patent Document 1) and Japanese Unexamined Patent Publication No. 2019-7075 (Patent Document 2). Japanese Unexamined Patent Publication No. 2018-40045 (Patent Document 1) describes a substrate holder configured to hold a substrate by fixing the substrate to a back plate by means of a clip, subsequently laying the back plate over a front plate, and fixing the front plate to the back plate by means of a clamp. Japanese Unexamined Patent Publication No. 2019-7075 (Patent Document 2) describes a substrate holder configured to feed the electric power via a bus bar to a plurality of substrate contacts placed in the periphery of a substrate.

Japanese Unexamined Patent Publication No. 2008-133526 (Patent Document 3) discloses an example of a plating jig serving to improve application of a pressing force to a substrate. This example is configured to lay a pressing member over a substrate placed in a recess on a jig body and to fix a cover member provided with a spring corresponding to the center of the substrate to an upper face of the jig body. This compresses the spring between the cover member and the pressing member to press the substrate against the seal member and thereby seal the substrate.

Japanese Unexamined Patent Publication No. 2007-46154 (Patent Document 4) discloses a work piece holder configured such that a locking mechanism of a ring is locked to a flexible member locked to a work piece holder body side and that the ring is pulled toward the work piece holder body side by the flexible member to press the substrate by a seal face of the ring. This work piece holder includes an expandable and contractable bag placed inside of the work piece holder body to deform the flexible member to such a degree as to be engageable with the locking mechanism of the ring.

RELATED ART DOCUMENT

Patent Document

Patent Document 1: Japanese Unexamined Patent Publication No. 2018-40045

Patent Document 2: Japanese Unexamined Patent Publication No. 2019-7075

Patent Document 3: Japanese Unexamined Patent Publication No. 2008-133526

Patent Document 4: Japanese Unexamined Patent Publication No. 200746154

SUMMARY OF INVENTION

These substrate holders use a seal that is formed in a continuous and integral shape along an outer circumference of the substrate and that is brought into contact with the substrate to protect a substrate contact from a plating solution. In order to achieve appropriate sealing of the substrate contact, a seal needs to be brought into contact with the substrate with a uniform pressing force over the full length of the seal. The substrate is, however, more likely to warp with an increase in size and/or thinning of the substrate. This makes it difficult for a continuous and integral seal to be brought into contact with the substrate with a uniform pressing force over the full length of the seal. Moreover, the continuous and integral seal suitable for the large-sized substrate needs to ensure the surface accuracy and/or the dimensional accuracy of the seal itself and relevant components over a long distance and a wide range corresponding to an outer circumferential part of the substrate. It is, however, difficult to manufacture the seal and the relevant components having the sufficient surface accuracy and/or the sufficient dimensional accuracy. This is likely to increase the cost of the substrate holder. Furthermore, the weight of the substrate holder is likely to increase with an increase in size of the substrate.

In some cases, the substrate holder may be required to position the seal and/or the substrate contact in a limited area corresponding to a contact allowable area of the substrate where the seal and/or the substrate contact is allowed to be brought into contact with.

There is also a need to reduce a load applied to the substrate when the seal is pressed against the substrate.

An object of the present disclosure is to solve at least part of the problems described above.

According to one aspect of the present disclosure, there is provided a substrate holder configured to hold a substrate, the substrate holder comprising: a first holding member, and a second holding member configured to hold the substrate between the first holding member and the second holding member, wherein the first holding member comprises: at least one substrate contact arranged to come into contact with the substrate; at least one seal member provided with a first seal portion configured to cover periphery of a leading end portion of one or a plurality of the substrate contacts; and at least one bus bar electrically connected with the one or plurality of substrate contacts and provided with one or a plurality of first through holes to receive the first seal portion, wherein the leading end portion of the one or plurality of substrate contacts is arranged to pass through the first through hole from a side opposite to the second holding member toward the second holding member and is fixed to the bus bar in a state that the periphery of the leading end portion of the one or plurality of substrate contacts is covered by the first seal portion.

According to one aspect of the present disclosure, there is a substrate holder, comprising: a contact assembly provided with a contact configured as an electric contact to come into contact with an outer circumferential part of a first face of a substrate, a seal member provided with a seal portion configured to cover a periphery of a leading end portion of the contact and to come into contact with the first face, and a holder body configured to hold the contact and the seal member; a first plate located on a second face side of the substrate and configured to hold the substrate between the contact assembly and the first plate; at least one first pin fixed to the holder body of the contact assembly, extended toward the second face side on outside of the substrate, and provided with a locked portion; a locking member placed on the second face side relative to the first plate and configured to be displaceable between a locked state/position and an unlocked state/position with respect to the locked portion of the first pin; and at least one first biasing member placed between the locking member and the first plate along the outer circumferential part of the substrate such as to separate the locking member and the first plate from each other and compressed between the locking member and the first plate in the locked state/position to bias the first plate toward the contact assembly.

According to one aspect of the present disclosure, there is provided a substrate holder, comprising: a contact assembly provided with a contact configured as an electric contact to come into contact with an outer circumferential part of a first face of a substrate, a seal member provided with a seal portion configured to come into contact with the first face on inside of the contact, and a holder body configured to hold the contact and the seal member; a first plate located on a second face side of the substrate and configured to hold the substrate between the contact assembly and the first plate; a plurality of first pins, each being fixed to the holder body of the contact assembly, extended toward the second face side on outside of the substrate, and provided with a locked portion; a locking member placed on the second face side relative to the first plate and configured to be displaceable between a locked state/position and an unlocked state/position with respect to the locked portion of the first pin; and a plurality of first biasing members provided along the outer circumferential part of the substrate, placed between the locking member and the first plate such as to separate the locking member and the first plate from each other, and compressed between the locking member and the first plate in the locked state/position to bias the first plate toward the contact assembly.

DESCRIPTION OF EMBODIMENTS

The following describes embodiments of a plating apparatus and a substrate holder used in the plating apparatus according to the present disclosure with reference to attached drawings. In the attached drawings, identical or similar components are expressed by identical or similar reference signs. In the explanation of the respective embodiments, overlapping description with regard to the identical or similar components may be omitted. Characteristics and features described in each of the embodiments are applicable to the other embodiments so far as they are not incompatible with each other.

In the description hereof, the term "substrate" includes not only semiconductor substrates, glass substrates, liquid crystal substrates and printed circuit boards but magnetic recording media, magnetic recording sensors, mirrors, optical elements, micromachine elements or partially manufactured integrated circuits, and any other objects to be processed. The substrate may be in any of various shapes including polygonal shapes and circular shapes. Although the expressions such as "front face", "back face", "front". "back", "upper (above)", "lower (below)", "left" and "right" are used in the description hereof, these expressions only indicate the positions and the directions on the sheet surfaces of the illustrative drawings for the purpose of explanation and may be different from the positions and the directions in the actual layout, for example, during use of the apparatus.

Figure 1:
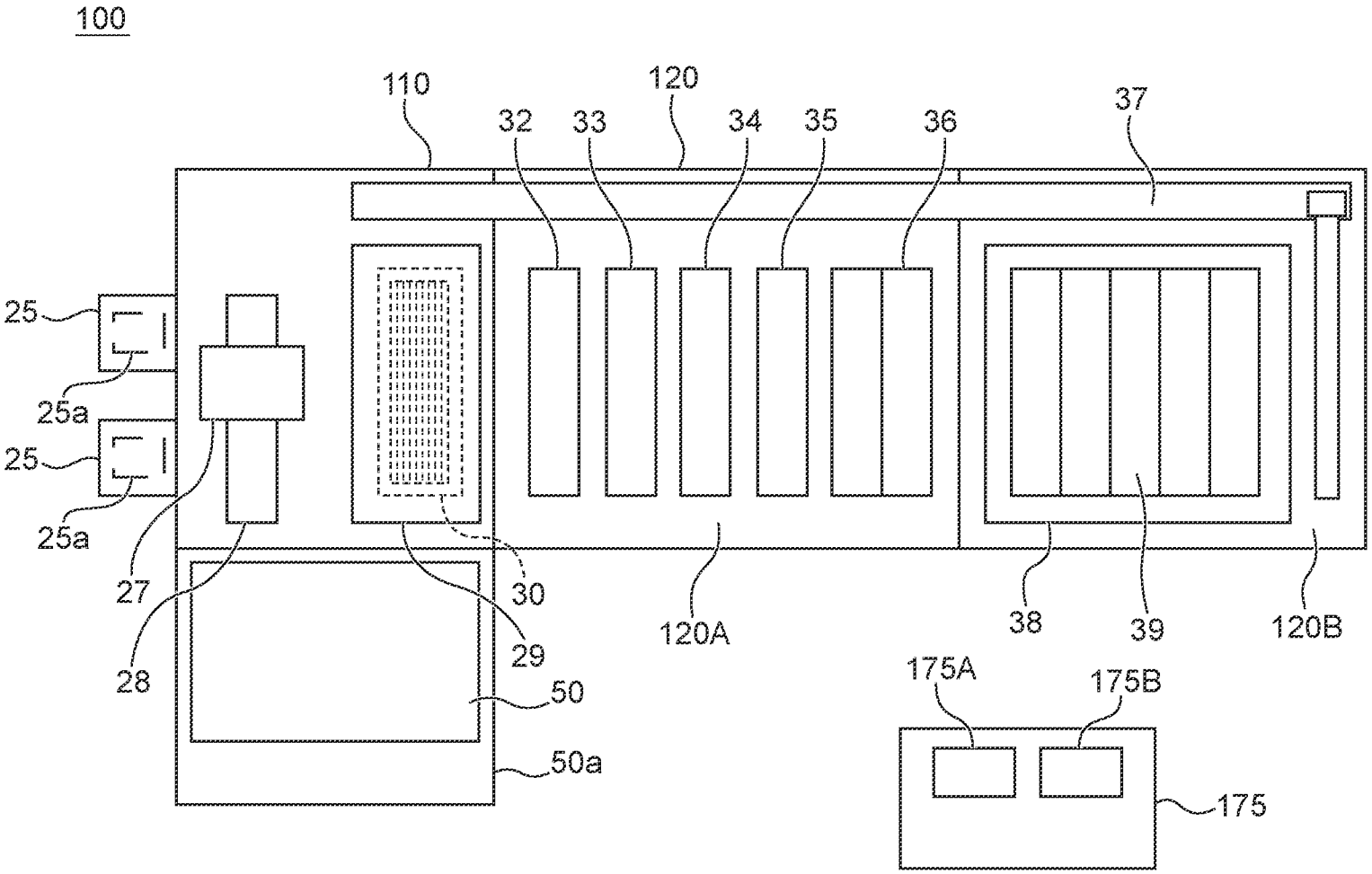
FIG. 1 is a general layout drawing illustrating a plating apparatus with a substrate holder according to one embodiment of the present disclosure used therefor.

FIG. 1 is a general layout drawing illustrating a plating apparatus with a substrate holder used therein according to one embodiment of the present disclosure. A plating apparatus 100 is configured to plate a substrate in such a state that the substrate is held by a substrate holder 200 (shown in FIG. 2). The plating apparatus 100 is roughly divided into a load/unload module 110 configured to load the substrate to the substrate holder 200 or unload the substrate from the substrate holder 200, a processing module 120 configured to process the substrate, and a cleaning module 50*a*. The processing module 120 further includes a pre-process/post-process module 120A configured to perform pre-process and post-process of the substrate and a plating module 120B configured to perform a plating process of the substrate.

The load/unload module 110 includes two cassette tables 25 and a substrate mounting/demounting mechanism 29. The cassette table 25 is configured to mount thereon a cassette 25*a* with the substate received therein. The substrate mounting/demounting mechanism 29 is configured to attach and detach the substrate to and from the substrate holder 200. A stocker 30 is provided in a neighborhood of (for example, below) the substrate mounting/demounting mechanism 29 to place the substrate holders 200 therein. The cleaning module 50*a* includes a cleaning device 50 configured to clean and dry the substrate after the plating process.

A substrate transporter 27 is placed at a location surrounded by the cassette tables 25, the substrate mounting/demounting mechanism 29 and the cleaning module 50*a*, and is configured by a carrier robot to transfer or convey the substrate between these components. The substrate transporter 27 is configured to be movable by a moving device 28. For example, the substrate transporter 27 is configured to take out a substrate prior to plating from the cassette 25*a* and transfer the substrate to the substrate mounting/demounting mechanism 29, to receive a substrate after plating from the substrate mounting/demounting mechanism 29, to transfer the substrate after plating to the cleaning module 50*a*, and to take out a cleaned and dried substrate from the cleaning module 50*a* and place the cleaned and dried substrate into the cassette 25*a*.

The pre-process/post-process module 120A includes a pre-wet module 32, a pre-soak module 33, a pre-rinse module 34, a blow module 35 and a rinse module 36. The pre-wet module 32 serves to soak a substrate in pure water. The pre-soak module 33 serves to remove an oxide film on the surface of a conductive layer such as a seed layer formed on the surface of the substrate by etching. The pre-rinse module 34 serves to clean the pre-soaked substrate along with a substrate holder with a cleaning liquid (for example, pure water). The blow module 35 serves to drain the liquid from the cleaned substrate. The rinse module 36 serves to clean the plated substrate along with the substrate holder with the cleaning liquid. The pre-wet module 32, the pre-soak module 33, the pre-rinse module 34, the blow module 35, and the rinse module 36 are arranged in this sequence. This configuration is, however, only illustrative, and the pre-process/post-process module 120A is not limited to this configuration described above but may adopt another configuration.

The plating module 120B includes a plurality of plating device (plating tanks or cells) 39, and an overflow tank 38. Each of the plating device 39 is configured to place one substrate inside thereof and to soak the substrate in a plating solution kept inside thereof and plate the surface of the substrate by copper plating or the like. The type of the plating solution is not specifically limited, but any of various plating solutions may be used according to the purposes.

The plating apparatus 100 includes a holder transporter 37 that is located on a side of these components and configured to transfer the substrate holder 200 along with the substrate between these components and that adopts, for example, a linear motor system. This holder transporter 37 is configured to transfer the substrate holder between the substrate mounting/demounting mechanism 29, the stocker 30, the pre-wet module 32, the pre-soak module 33, the pre-rinse module 34, the blow module 35, the rinse module 36 and the plating device 39.

The plating apparatus 100 having the configuration described above includes a controller 175 that serves a control module configured to control the respective components described above. The controller 175 includes a memory 175B configured to store predetermined programs and a CPU 175A configured to execute the programs stored in the memory 175B. A storage medium that constitutes the memory 175B is configured to store, for example, a variety of set data and various programs including a program to control the plating apparatus 100. The programs include, for example, programs that perform transfer control of the substrate transporter 27, mounting and demounting control of mounting and demounting the substrate to and from the substrate holder by the substrate mounting/demounting mechanism 29, transfer control of the holder transporter 37, control of the processings in the respective processing modules, control of the plating process in the respective plating device 39, and control of the cleaning module 50*a*. The storage medium may include nonvolatile and/or volatile storage media. The storage medium used may be any of known storage media, for example, a computer readable memory such as a ROM, a RAM or a flash memory or a disk-type storage medium such as a hard disk, a CD-ROM, a DVD-ROM or a flexible disk.

The controller 175 is configured to make communication with a non-illustrated upper level controller that performs integrated control of the plating apparatus 100 and the other relevant devices and to send and receive data to and from a database of the upper level controller. Part or the entirety of the functions of the controller 175 may be configured by a hardware such as ASIC. Part or the entirety of the functions of the controller 175 may be configured by a sequencer. Part or the entirety of the controller 175 may be placed on inside and/or outside of a housing of the plating apparatus 100. Part or the entirety of the controller 175 is connected to make communication with the respective components of the plating apparatus 100 by wire or wirelessly.

(Substrate Holder)

Figure 2:
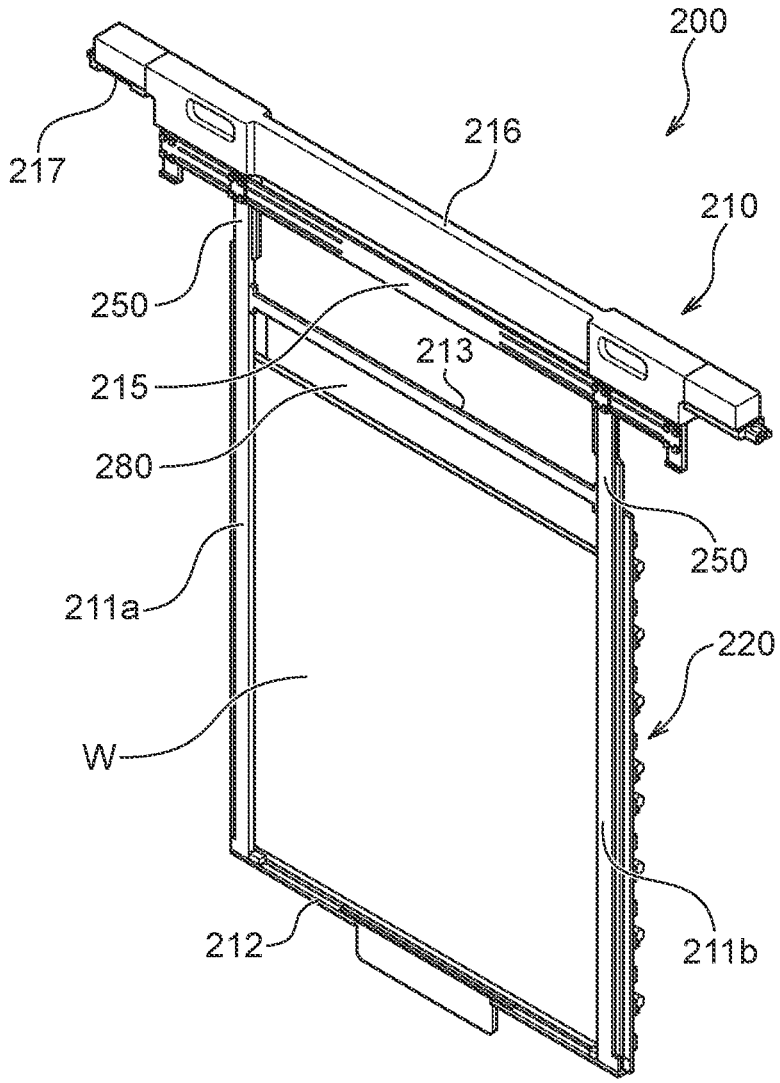
FIG. 2 is a perspective view illustrating the substrate holder viewed from a front face side thereof.
Figure 3:
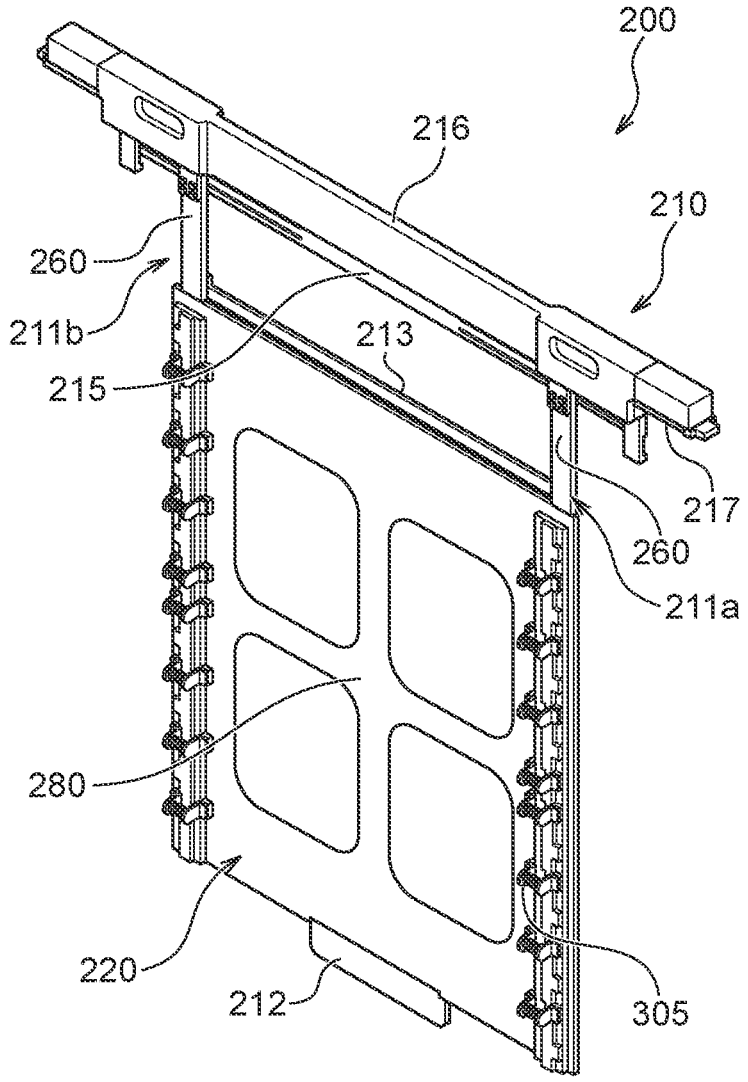
FIG. 3 is a perspective view illustrating the substrate holder viewed from a back face side thereof.
Figure 4:
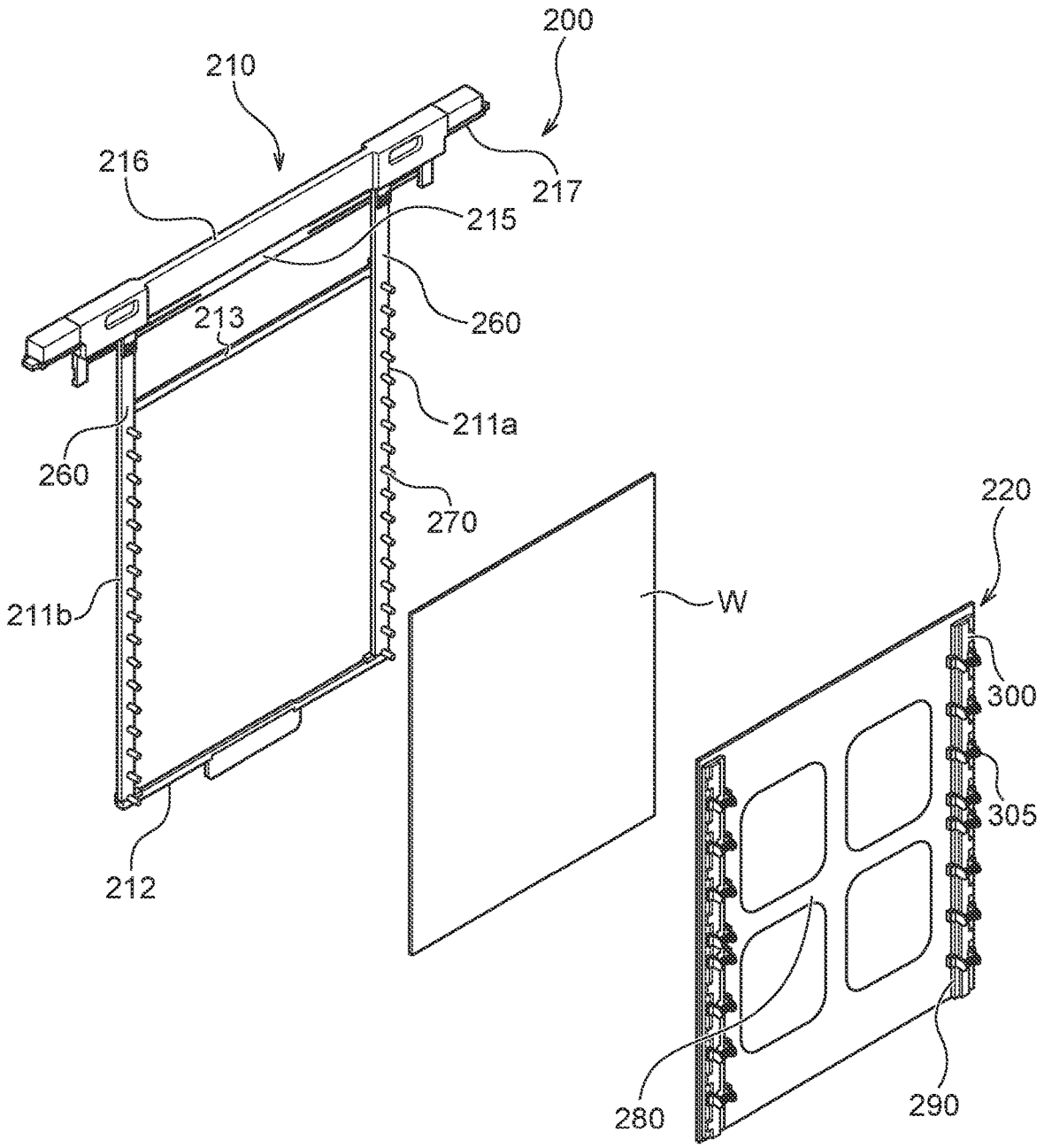
FIG. 4 is a perspective view illustrating the substrate holder in such a state that respective holding members are separated.
Figure 5:
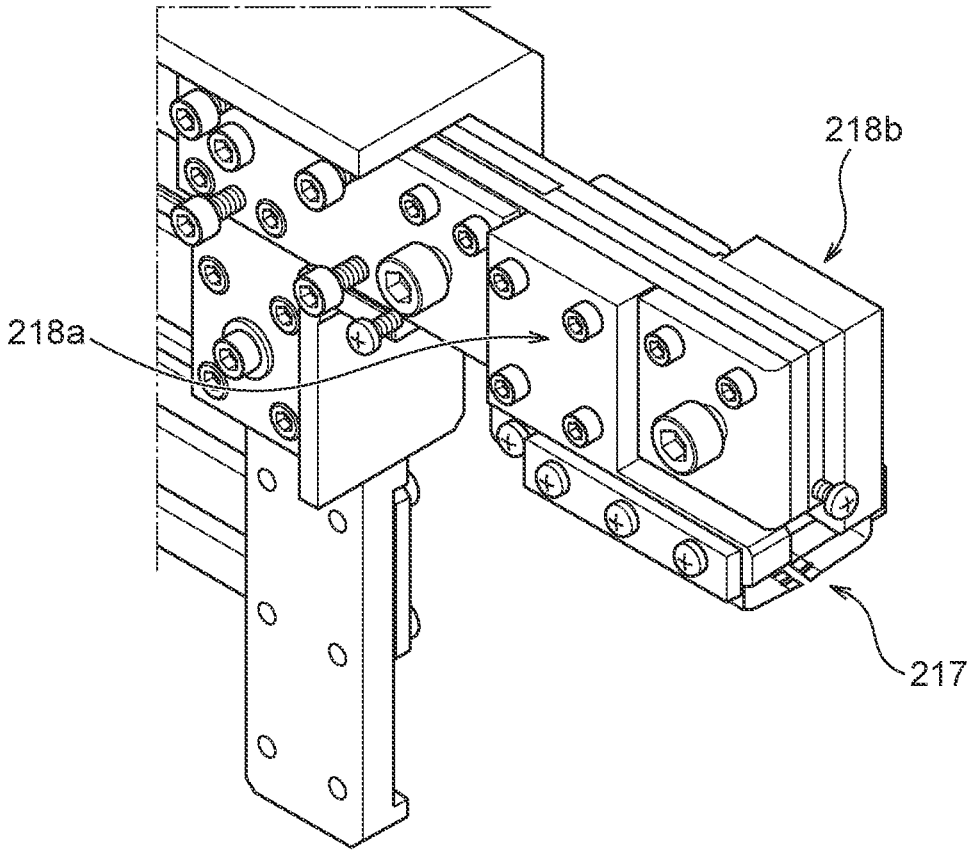
FIG. 5 is an enlarged perspective view illustrating an external connecting portion of the substrate holder.

FIG. 2 is a perspective view illustrating the substrate holder viewed from a front face side. FIG. 3 is a perspective view illustrating the substrate holder viewed from a back face side. FIG. 4 is a perspective view illustrating the substrate holder in such a state that respective holding members are separated. FIG. 5 is an enlarged perspective view illustrating an external connecting portion of the substrate holder. This substrate holder 200 includes a first holding member 210 and a second holding member 220 and holds a substrate W in such a state that the substrate W is placed between the first holding member 210 and the second holding member 220.

The first holding member 210 includes a longitudinal member 211*a*, a longitudinal member 211*b*, a transverse member 212, a transverse member 213, a rail 215, an arm 216, and an external connecting portion 217. The first holding member 210 also includes a plurality of pins 270 (shown in FIG. 4) serving as a locking mechanism to lock the first holding member 210 to the second holding member 220. The longitudinal member 211*a* and the longitudinal member 211*b* are extended approximately parallel to each other and respectively have a power feed device including a substrate contact (described later) serving as an electric contact that comes into contact with a front face of the substrate W to make the flow of electric current. This embodiment illustrates a configuration that only the longitudinal member 211*a* and the longitudinal member 211*b* are provided with the power feed devices. According to another embodiment, the transverse member 212 and/or the transverse member 213 may be provided with power feed devices, in place of or in addition to the longitudinal member 211*a* and/or the longitudinal member 211*b*. The transverse member 212 is configured to link the longitudinal member 211*a* and the longitudinal member 211*b* with each other on aside farther from the arm 216. The transverse member 213 is configured to link the longitudinal member 211*a* and the longitudinal member 211*b* with each other on a side nearer to the arm 216. The transverse members 212 and 213 serve to support the longitudinal members 211*a* and 211*b* and suppress deflection. The front face of the substrate W is exposed in an area surrounded by these longitudinal members 211*a* and 211*b* and transverse members 212 and 213. According to a modification, the substrate holder may be formed in a portal shape with omission of the transverse members 212 and 213.

The rail 215 is mounted approximately parallel to the arm 216. The longitudinal members 211*a* and 211*b* are mounted to be slidable along the rail 215. The rail 215 is configured such that the positions of the longitudinal members 211*a* and 211*b* are adjustable according to the dimensions of the substrate W by moving the longitudinal members 211*a* and 211*b* along the rail 215 to become closer to each other or to become away from each other.

The arm 216 is a grip portion held by the holder transporter 37 and serves as a part that is supported when the substrate holder is placed in each of the processing modules or tanks. The arm 216 is extended approximately perpendicular to the longitudinal member 211*a*, and the external connecting portion 217 is provided on one end of the arm 216. According to another embodiment, the external connecting portions 217 may be provided on respective ends of the arm 216. The external connecting portion 217 is an external connection terminal used to electrically connect the substrate holder 200 with an external power source and includes a plurality of externally connecting contacts configured by, for example, leaf electrodes (as shown in FIG. 5). Part of the externally connecting contacts (on a front side of FIG. 5) is electrically connected with a bus bar 218*a*, whereas another part of the externally connecting contacts (on a back side of FIG. 5) is electrically connected with a bus bar 218*b*. The bus bars 218*a* and 218*b* may be appropriately covered with a cover or a protective member. The bus bar 218*a* is extended along a longitudinal direction of the arm 216 and is configured to be mechanically and electrically connected with a bus bar 260 of the longitudinal member 211*a* (shown in FIG. 3). The bus bar 218*a* is configured to be connectable with the bus bar 260 of the longitudinal member 211*a* at a plurality of positions according to adjustment of the position of the longitudinal member 211*a*. The bus bar 218*b* is extended along the longitudinal direction of the arm 216 and is configured to be mechanically and electrically connected with a bus bar 260 of the longitudinal member 211*b* (shown in FIG. 3). The bus bar 218*b* is configured to be connectable with the bus bar 260 of the longitudinal member 211*b* at a plurality of positions according to adjustment of the position of the longitudinal member 211*b*. In one example, the connecting positions of the bus bars 218*a* and 218*b* with the bus bars 260 of the longitudinal members 211*a* and 211*b* are placed inside of the cover or the protective member.

The second holding member 220 has a back plate 280 and a locking mechanism including lock plates 300 that are provided on the back plate 280 and that serve to lock the second holding member 220 on the first holding member 210. The locking mechanism includes the lock plates 300 extended corresponding to the longitudinal members 211*a* and 211*b*, float plates 290 placed between the back plate 280 and the lock plates 300 and extended corresponding to the lock plates 300, and biasing mechanisms 305 configured to generate a biasing force between the lock plates 300 and the float plates 290. The details of the locking mechanism will be described later.

(Power Feed Module)

Figure 6:
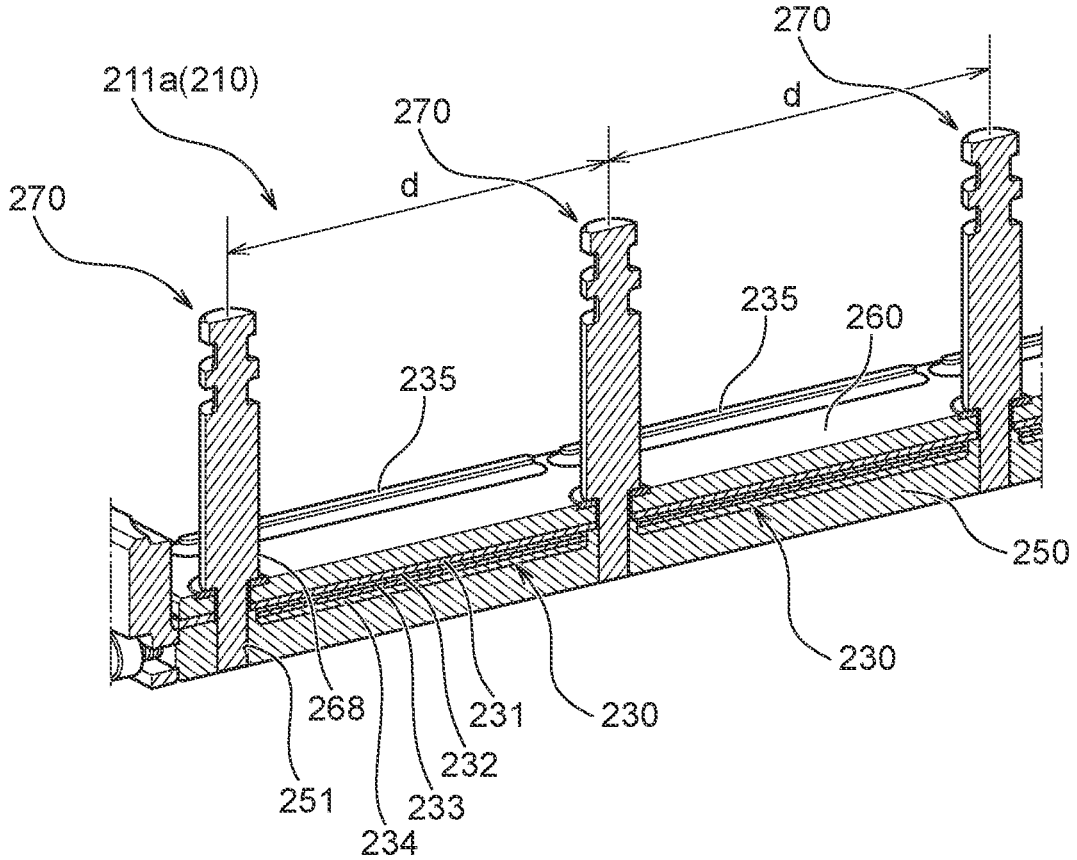
FIG. 6 is a longitudinal sectional view illustrating a longitudinal member.

FIG. 6 is a longitudinal sectional view illustrating the longitudinal member. The longitudinal member 211*a* and the longitudinal member 211*b* have similar configurations. The following accordingly describes the longitudinal member 211*a* as an example. As illustrated, the longitudinal member 211*a* includes a front plate 250, the bus bar 260, a plurality of power feed modules 230 that are electrically connected with the bus bar 260, and a plurality of pins 270 that are placed on respective sides of each of the power feed modules 230 (between adjacent power feed modules 230 and outside of power feed modules 230 on respective ends). In FIG. 6, an interval between adjacent pins 270 is expressed by d. The surface of the bus bar 260 other than some part is coated by insulation coating. More specifically, the surface of the bus bar 260 other than a contact location which a substrate contact 233 described later comes into contact with (surface of a projection 264) is coated by insulation coating. The insulation coating protects the bus bar 260 from the plating solution and prevents the electric current from directly flowing from the plating solution to the bus bar 260.

As shown in FIG. 3 and FIG. 4, the bus bar 260 is extended over the full length of the longitudinal member 211*a* and is configured to be mechanically connected with the rail 215 and to be mechanically and electrically connected with the bus bars 218*a* and 218*b* in the arm 216 (shown in FIG. 5) as described above. The bus bar 260 is electrically connected with the external connecting portion 217 via the bus bars 218*a* and 218*b* in the arm 216. As shown in FIG. 2 and FIG. 6, the front plate 250 is provided on a front face side of the bus bar 260 and is extended along the bus bar 260 over the full length of the longitudinal member 211*a*. The front plate 250 serves along with a seal member 231 to shield the substrate contact 233 from the plating solution. The front plate 250 may be made of a material that is the same as the material of the seal member 231.

The power feed modules 230 are power feed units that configure the power feed device and are respectively placed on the front face side of the bus bar 260 along the longitudinal member 211*a* as shown in FIG. 6. In this embodiment, the power feed modules 230 are placed between the bus bar 260 and the front plate 250. As described later with reference to FIG. 7, each of the power feed modules 230 has a substrate contact 233 and is arranged such that a contact leading end 243 of the substrate contact 233 is extended across a through hole 263 of the bus bar 260 to a back face side of the bus bar 260 (a side opposite to the front plate 250) to come into contact with the substrate W.

Figure 7:
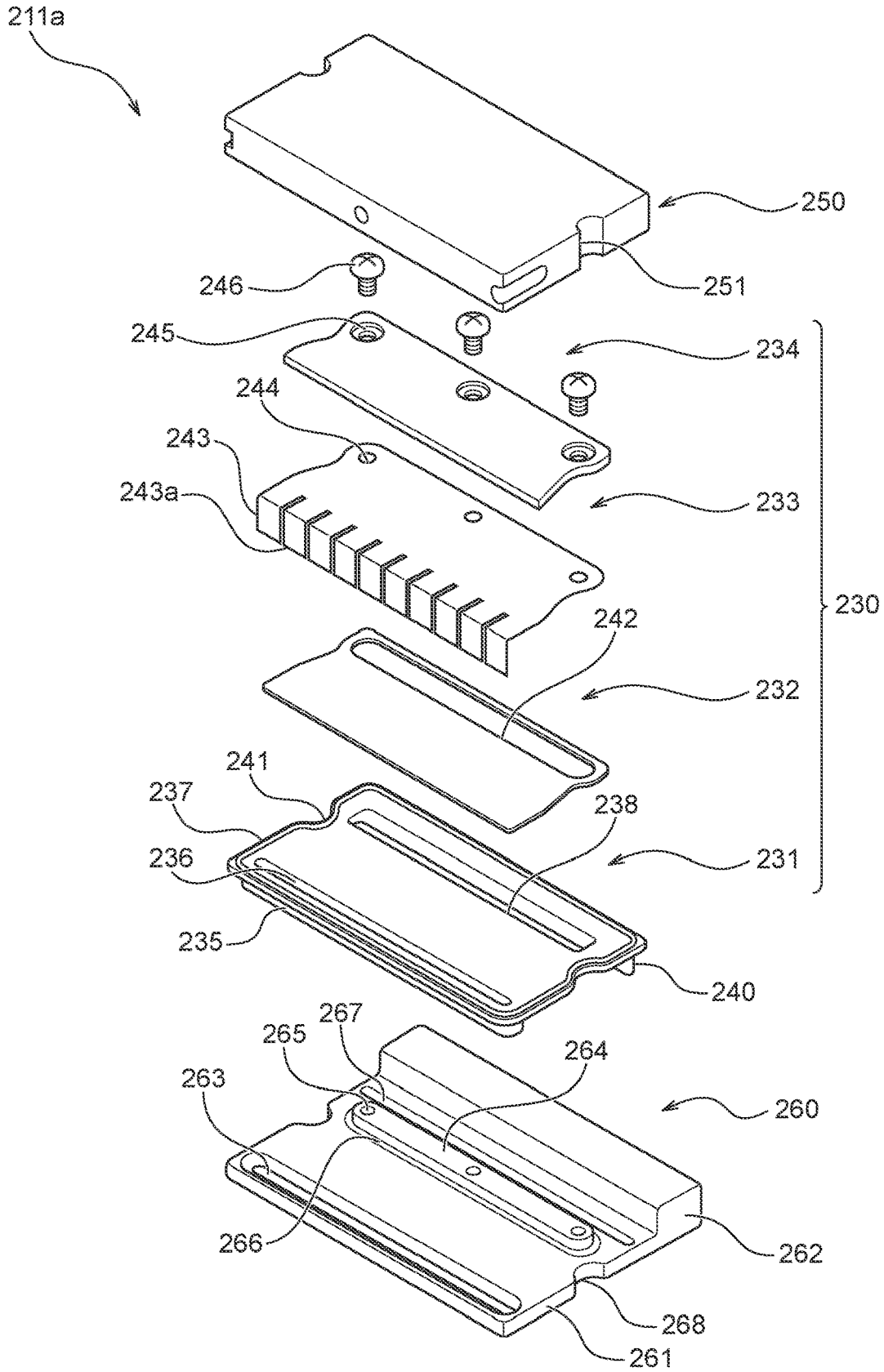
FIG. 7 is an exploded perspective view illustrating the longitudinal member.
Figure 8:
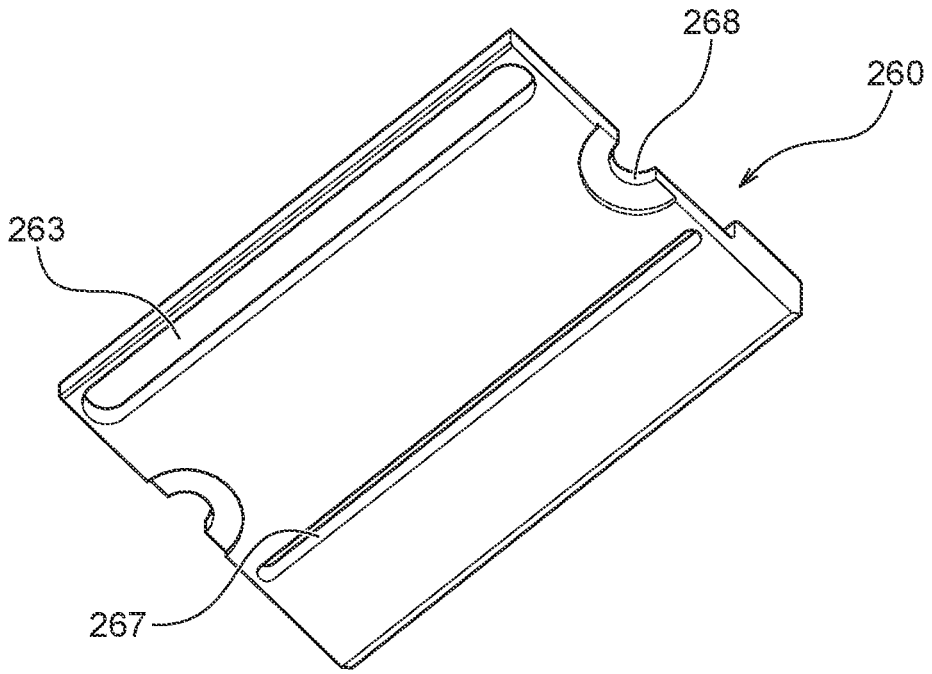
FIG. 8 is a perspective view illustrating a bus bar viewed from a back face side thereof in one unit length of a contact seal module.
Figure 9:
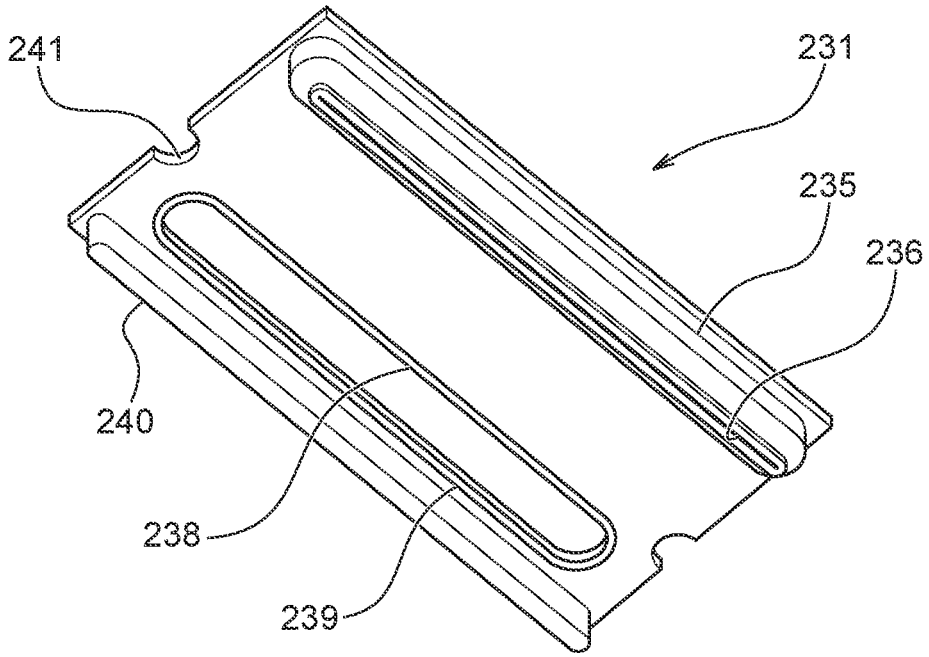
FIG. 9 is a perspective view illustrating a seal member viewed from a back face side thereof.
Figure 10:
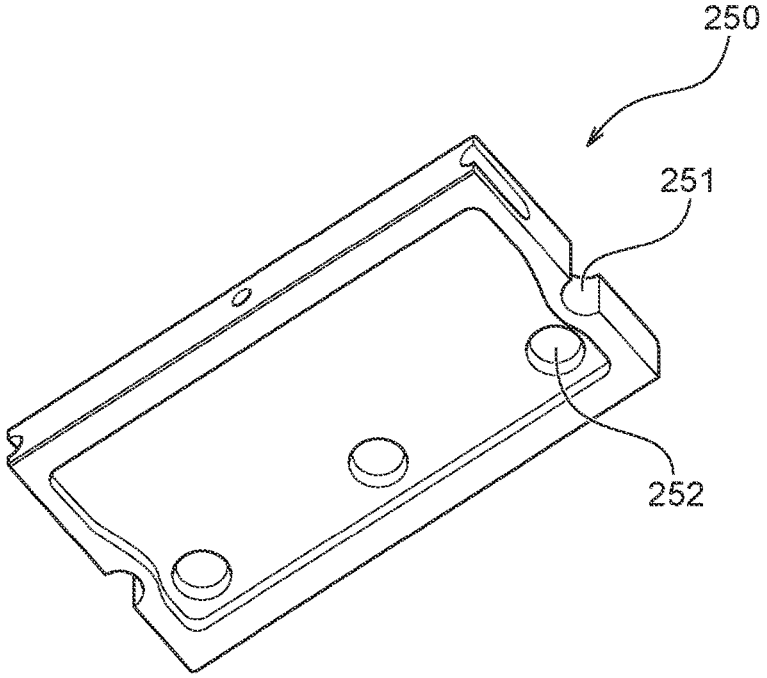
FIG. 10 is a perspective view illustrating a front plate viewed from a back face side thereof in one unit length of the contact seal module.

FIG. 7 is an exploded perspective view illustrating the longitudinal member. FIG. 8 is a perspective view illustrating the bus bar viewed from a back face side thereof. FIG. 9 is a perspective view illustrating the seal member viewed from a back face side thereof. FIG. 10 is a perspective view illustrating the front plate viewed from a back face side thereof. FIG. 1 is a cross sectional view illustrating the longitudinal member in closeup of the vicinity of the power feed module. As shown in FIG. 6, the front plate 250 and the bus bar 260 are extended over the full length of the longitudinal member 211*a*. FIG. 7, however, illustrates only portions corresponding to one power feed module 230, with a view to avoiding the complication of illustration.

The power feed module 230 includes the seal member 231, a support plate 232, the substrate contact 233, and a pressing plate 234. The seal member 231 is an elastic member (made of an elastomer such as rubber) having a substantially rectangular shape and includes a seal portion 235, a through hole 236 provided in the seal portion 235, a seal portion 237 provided on a front face side of the seal member 231 (on an upper face in FIG. 7), a through hole 238 provided outside of the through hole 236, a seal potion 239 provided around the through hole 238 on a back face side of the seal member 231 (shown in FIG. 9), a protrusion 240 provided outside of the through hole 238 on the back face side of the seal member 231 (shown in FIG. 9), and cuts 241 configured to receive the pins 270.

Figure 11:
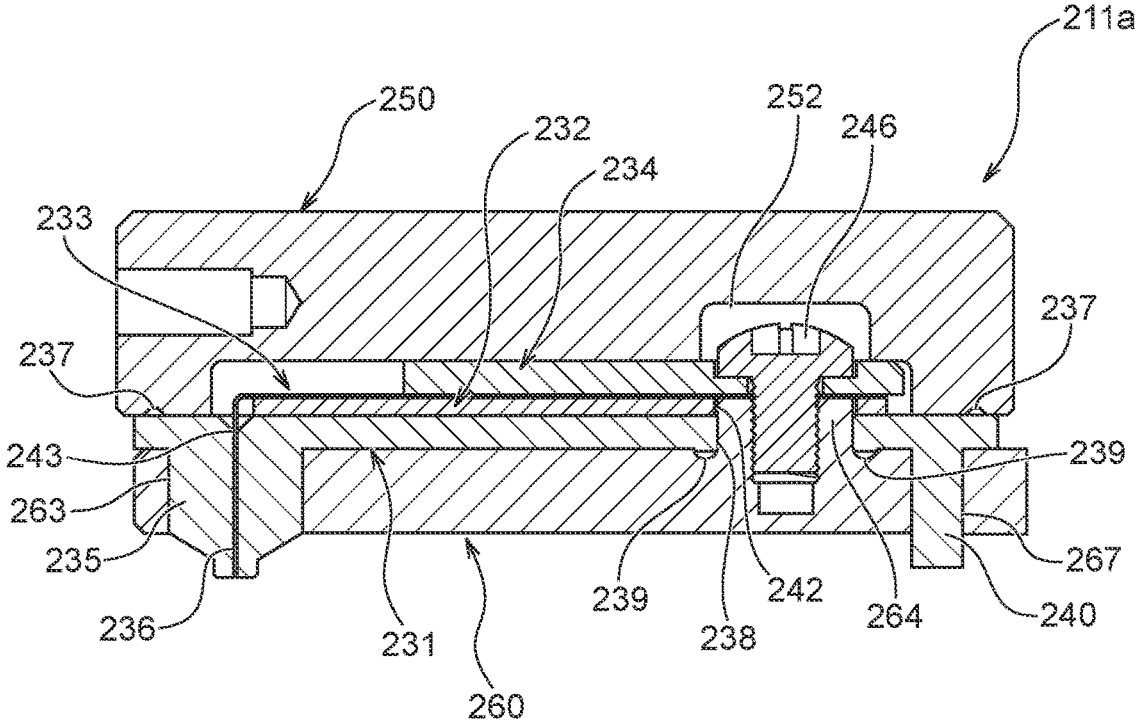
FIG. 11 is a cross sectional view illustrating the longitudinal member in closeup of the vicinity of a power feed module.

As shown in FIG. 11, the seal portion 235 is made to pass through the through hole 263 of the bus bar 260 and is exposed on a back face side of the longitudinal member 211*a* (on a lower side of this drawing). The seal portion 235 is formed in such a length as to be extended by a predetermined length from a back face of the bus bar 260. The through hole 236 is provided in the seal portion 235 to penetrate from the front face side to the back face side of the seal member 231. The contact leading end 243 of the substrate contact 233 is inserted in the through hole 236. The contact leading end 243 is extended to be flush with a back face side opening of the through hole 236 or to a position short of the back face side opening of the through hole 236 by a predetermined length. According to a modification, the contact leading end 243 may be protruded by a predetermined length from the back face side opening of the through hole 236. The through hole 236 is configured, for example, to cover the entire circumference of the contact leading end 243 of the substrate contact 233. The through hole 236 is formed in such dimensions that the contact leading end 243 is arranged inside of the through hole 236 across a small clearance from an inner wall of the seal portion 235 or to be in close contact with or adhere to the inner wall of the seal portion 235. The contact leading end 243 may be stuck to the seal portion 235 in the through hole 236 by using an adhesive or the like.

This embodiment describes a configuration that the seal member 231 is provided with respect to each of the substrate contacts 233. According to a modification, one seal member 231 may be provided with respect to a plurality of the substrate contact 233. According to another modification, a different number of substrate contacts 233 may be provided with respect to each of the seal members 231.

Figure 27:
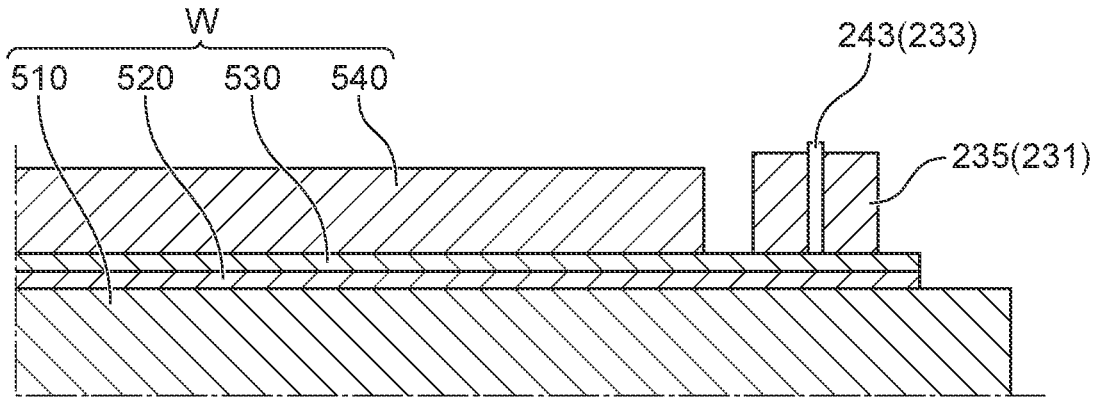
FIG. 27 is a sectional view a illustrating contact position of a seal portion on a substrate.

The seal portion 235 is brought into contact with and pressed against a seed layer 530 on the substrate W as shown in FIG. 27. The entirety of (the leading end) of the seal portion 235 that covers and surrounds the contact leading end 243 is brought into contact with the seed layer 530 in such an area that the seed layer 530 is not covered with a resist 540. In this drawing, a reference sign 510 indicates a bear substrate, and a reference sign 520 indicates another component such as an insulating layer. This configuration causes the entirety of the seal portion 235 in the periphery of the contact leading end 243 to come into contact with an equal height part on the substrate W (for example, with the surface of the seed layer 530 in an outer circumferential part of the substrate). This enhances the sealing property of the contact leading end 243 by the seal portion 235.

The shapes and the dimensions of the seal portion 235 and the through hole 236 may be any arbitrary shapes and dimensions according to the shape and the dimensions of the contact leading end 243 of the substrate contact 233. For example, the seal portion 235 and the through hole 236 may respectively be an elongated shape portion and a long hole in a slit-like shape that are respectively extended approximately parallel along the longitudinal member 211*a* as shown in FIG. 7.

The seal portion 237 is provided along an outer circumferential part on a front face of the seal member 231 and is configured to seal between the front plate 250 and the seal member 231 and to protect the substrate contact 233 from the plating solution as shown in FIG. 11. The seal portion 237 may be a projection provided integrally with the seal member 231 or may be configured by attaching a separate member such as an O-ring to the seal member body.

The through hole 238 is provided outside of the through hole 236 to penetrate from the front face side to the back face side. The shape and the dimensions of the through hole 238 may be any arbitrary shape and dimensions according to the shape and the dimensions of a base end portion of the substrate contact 233 (the projection 264 of the bus bar 260). For example, the through hole 238 may be a long hole extended approximately parallel to the through hole 236 as shown in FIG. 7. As shown in FIG. 11, the projection 264 of the bus bar 260 is made to pass through the through hole 238, and an end face of the projection 264 of the bus bar 260 is exposed on a front face side of the substrate holder. It is preferable that the projection 264 of the bus bar 260 is protruded by a predetermined length from the front face of the seal member 231 such as to expose the end face of the projection 264, in order to facilitate the connection with the substrate contact 233.

As shown in FIG. 9 and FIG. 11, the seal portion 239 is provided around the through hole 238 on a back face of the seal member 231 and is configured to seal between the seal member 231 and the bus bar 260 around the projection 264 and to protect the substrate contact 233 connected with the projection 264 from the plating solution. The seal portion 239 may be a projection provided integrally with the seal member 231 or may be configured by attaching a separate member such as an O-ring to the seal member body.

As shown in FIG. 9 and FIG. 11, the protrusion 240 is provided outside of the through hole 238 to be protruded from the back face of the seal member 231. The protrusion 240 serves as a support to abut against the second holding member 220 and serves as a pressure receiver to receive a pressing force from the second holding member 220 when the substrate W is held by the substrate holder 200. Since the protrusion 240, along with the seal portion 235, serves as the pressure receiver to receive the pressing force from the second holding member 220, it is preferable to form the protrusion 240 having the shape and the dimensions adequate for those of the seal portion 235. For example, as shown in FIG. 7 and FIG. 9, the protrusion 240 is formed in an elongated shape to be extended approximately parallel to the seal portion 235 and to have an approximately identical length with that of the seal portion 235. The protrusion 240 is extended to pass through a through hole 267 of the bus bar 260 toward the second holding member 220 (not shown) placed on the back face side as shown in FIG. 11. The protrusion 240 serves as the pressure receiver to come into contact with the second holding member 220 and receive part of the pressing force of the second holding member 220 against the first holding member 210 when the substrate W is held by the first holding member 210 and the second holding member 220.

As shown in FIG. 7 and FIG. 11, the support plate 232 is placed between the seal member 231 and the substrate contact 233 to support the seal member 231 and the substrate contact 233. The support plate 232 is formed to have a thickness that is equal to or slightly lower than the height of the projection 264 of the bus bar 260 protruded from the seal member 231. The support plate 232 is provided with a through hole 242 that is formed substantially corresponding to the through hole 238 of the seal member 231 and that causes the projection 264 of the bus bar 260 to pass through. The through hole 242 may be slightly larger than the through hole 238.

As shown in FIG. 7, the substrate contact 233 has the contact leading end 243 that comes into contact with the substrate W and is provided with one or a plurality of through holes 244 in its base end portion to cause screws 246 to pass through. The contact leading end 243 may have one or a plurality of leaf electrodes 243*a* or claw-like electrodes 243*a* as shown in FIG. 7. The base end portion of the substrate contact 233 is fixed to an end face of the projection 264 of the bus bar 260 by the screws 246 that pass through the through holes 244 and is electrically connected with the bus bar 260 as shown in FIG. 11. The contact leading end 243 is placed in the through hole 236 of the seal portion 235, is arranged to pass through the through hole 263 of the bus bar 260 from the front face side toward the back face side in a state that the contact leading end 243 is covered with the seal portion 235, and is positioned relative to and fixed to the bus bar 260.

As shown in FIG. 7, the pressing plate 234 has through holes 245 formed to cause the screws 246 to pass through. The pressing plate 234 is arranged to hold the substrate contact 233, in cooperation with the support plate 232 and the projection 264 of the bus bar 260, and is placed to press the substrate contact 233 against the support plate 232 and the projection 264 as shown in FIG. 11. As illustrated in this drawing, in the state that the substrate contact 233 and the pressing plate 234 are placed on the support plate 232 and the projection 264, the screws 246 that pass through the through holes 245 of the pressing plate 234 and the through holes 244 of the substrate contact 233 are screwed to the end face of the projection 264 of the sub bar 260. This causes the substrate contact 233 to be fixed to the end face of the projection 264 of the bus bar 260 in the state that the substrate contact 233 is pressed against the support plate 232 and the projection 264 by the pressing plate 234. This ensures electrical connection of the substrate contact 233 with the end face of the projection 264 of the bus bar 260.

The bus bar 260 includes a holder portion 261 to mount the power feed module 230 and a thick wall portion 262 provided outside of the holder portion 261. The holder portion 261 has the through hole 263 provided to cause the seal member 231 to pass through; the projection 264 provided to be connected with the substrate contact 233; screw holes 265 formed in the end face of the projection 264; a through hole 267 provided to cause the protrusion 240 of the seal member 231 to pass through; and through holes 268 provided to cause the pins 270 to pass through. The surface of the bus bar 260 other than the projection 264 that is to be connected with the substrate contact 233 is subjected to surface coating, such as PFA coating, which gives the electrical insulating properties and the corrosion resistance, so as to ensure the electric insulation and the corrosion resistance against the plating solution.

The through hole 263 is an open hole penetrating from the front face side to the back face side. The shape and the dimensions of the through hole 263 may be any arbitrary shape and dimensions according to the shape and the dimensions of the seal portion 235. For example, the through hole 263 may be a slit-like long hole extended approximately parallel along the longitudinal member 211*a* as shown in FIG. 7. As shown in FIG. 11, the through hole 263 is configured to receive the seal portion 235 that covers the entire circumference of the contact leading end 243 of the substrate contact 233 and to position the contact leading end 243 and the seal portion 235.

The projection 264 is formed outside of the through hole 263 to be approximately parallel to the through hole 263. One or a plurality of screw holes 265 are formed in the end face of the projection 264 to receive the screws 246 screwed thereto for fixation of the substrate contact 233. A seal groove 266 may be provided on the base end side around the projection 264 to receive the seal portion 239 of the seal member 231 therein.

The through hole 267 is formed outside of the projection 264 to be approximately parallel to the projection 264. As shown in FIG. 11, the through hole 267 causes the protrusion 240 of the seal member 231 to pass through and to be protruded by a predetermined length toward the back face side of the bus bar 260. The shape and the dimensions of the through hole 267 may be any arbitrary shape and dimensions according to the shape and the dimensions of the protrusion 240 of the seal member 231.

As shown in FIG. 6, the through holes 268 are open holes provided to cause the pins 270 to pass through. FIG. 7 illustrates only the part of the bus bar 260 corresponding to one power feed module 230 and thereby illustrates only part of the through holes 268.

As shown in FIG. 11, the front plate 250 is placed on the front face side of the first holding member 210. One or a plurality of recesses 252 are provided in a back face of the front plate 250 to receive the heads of the screws 246 used to fix the substrate contact 233, as shown in FIG. 10 and FIG. 11. As shown in FIG. 6 and FIG. 7, the front plate 250 has through holes (female threads) 251 that respectively mate with male threaded portions of the pins 270 and is fixed such as to enclose the bus bar 260 and the like by screwing with the pins 270. The through holes (female threads) 251 are through female threads screwed to the pins 270 as shown in FIG. 6. FIG. 7 illustrates only part of the front plate 250 corresponding to one power feed module 230 and thereby illustrates only part of the through holes (female threads) 251. The pin 270 includes a middle portion 272 (shown in FIG. 14) and has a level difference from a leading end portion 271 to abut against the bus bar 260. When the pins 270 are screwed into the female threads 251, this configuration causes the components from the front plate 250 to the bus bar 260 to be integrated and causes the respective members of the power feed module 230 to be placed/fixed (integrated) according to a predetermined positional relationship between the front plate 250 and the bus bar 260.

The configuration described above causes the contact leading end 243 of the substrate contact 233 to pass through the through hole 263 of the bus bar 260 and to be positioned in the state that the contact leading end 243 of the substrate contact 233 is covered with the seal portion 235. The bus bar 260 serves to accurately position and hold the contact leading end 243 and the seal portion 235 relative to the substrate. There is accordingly no need to separately provide a seal holding member that positions and holds the seal portion 235. This simplifies the configuration of the substrate holder 200. As a result, this configuration enables the substrate contact 233 and the seal member 231 to be accurately positioned in a narrow location. As shown in FIG. 27, the width of the exposed area of the seed layer 530 on the outer circumference of the substrate, which the contact leading end 243 and the seal portion 235 come into contact with, becomes extremely small with advancement of devices. According to the embodiment, the contact leading end 243 is mounted to the bus bar 260 across the through hole 263 of the bus bar 260 in the state that the contact leading end 243 is covered with the seal portion 235. This enables the contact leading end 243 to be accurately mounted to the bus bar 260 as a power feed pathway without requiring any additional structure. Additionally, the through hole 263 suppresses deformation of the contact leading end 243 and the seal portion 235 (in a direction parallel to the surface of the substrate) when the contact leading end 243 and the seal portion 235 are pressed against the substrate. This configuration thus ensures the sufficient sealing pressure and the contact pressure of the contact leading end 243 against the substrate.

The configuration described above causes the entire circumference of the contact leading end 243 of the substrate contact 233 to be closely covered with the seal portion 235. This configuration effectively seals the contact leading end 243 of the substrate contact 233 and keeps the periphery of the contact leading end 243 dried. Furthermore, the contact leading end 243 is placed across a small clearance from or in close contact with an inner wall of the through hole 236 of the seal portion 235, so that there is no space or very little space around the contact leading end 243 in the through hole 236. This configuration accordingly reduces the entering amount of the plating solution to a very small quantity even when the plating solution enters the through hole 236. This suppresses the bipolar phenomenon that makes the flow of shunt current in the substrate seed layer 530 and suppresses dissolution of the substrate seed layer 530. Since there is no space or very little space around the contact leading end 243 in the through hole 236, there is no air or very little air in the through hole 236. Even when a little amount of the plating solution enters the through hole 236, this configuration accordingly suppresses dissolution of the substrate seed layer caused by etching in the vicinity of a gas liquid interface due to the exposure and contact of the plating solution to and with the air (galvanic corrosion by dissolved oxygen concentration gradient).

In the configuration described above, the seal members 231 and the substrate contacts 233 are provided in the form of multiple modules (power feed modules 230). Even in the case of a large-sized substrate, this configuration further facilitates manufacture of the seal member 231 that effectively seals one or a plurality of substrate contacts 233 provided along the length of a side of the substrate. The seal members 231 and the substrate contacts 233 are arranged in the form of multiple modules (contact seal modules). This achieves the local seal structure to effectively seal the substrate contact 233 by means of the seal member 231 with respect to the length of each module. With reference to FIG. 27, the conventional substrate holders (for example, the substrate holders described in Japanese Unexamined Patent Publication No. 2018-40045 (Patent Document 1) and Japanese Unexamined Patent Publication No. 2019-7075 (Patent Document 2)) are configured such that a seal provided inside of a substrate contact is brought into contact with the surface of a resist 540. The conventional configurations, however, require a large-sized seal member that uniformly covers the outer circumference of the substrate.

The configuration described above allows the substrate contact 233 and/or the seal member 231 to be individually replaced in the unit of each power feed module 230. This facilitates maintenance and reduces the maintenance cost.

The configuration described above enables the power feed modules 230 to be placed according to the size of the substrate used and improves the versatility of the substrate holder. Omission of the power feed module 230 in a non-use area of the bus bar 260 (a part where the substrate is not brought into contact with) reduces the cost of the substrate holder. A dummy member may be placed in the part with omission of the power feed module 230 to shield the bus bar 260 from the plating solution and prevent the electric current from directly flowing from the plating solution to the bus bar 260. The dummy member may be formed to have a shape and dimensions corresponding to one or a plurality of power feed modules 230 shown in FIG. 7. Like the power feed module 230, the dummy member may be configured to be fixed to the projection 264 of the bus bar 260 by using the screws 246, the pressing plate 234 and the support plate 232.

(Substrate Holder Locking Mechanism)

Figure 12:
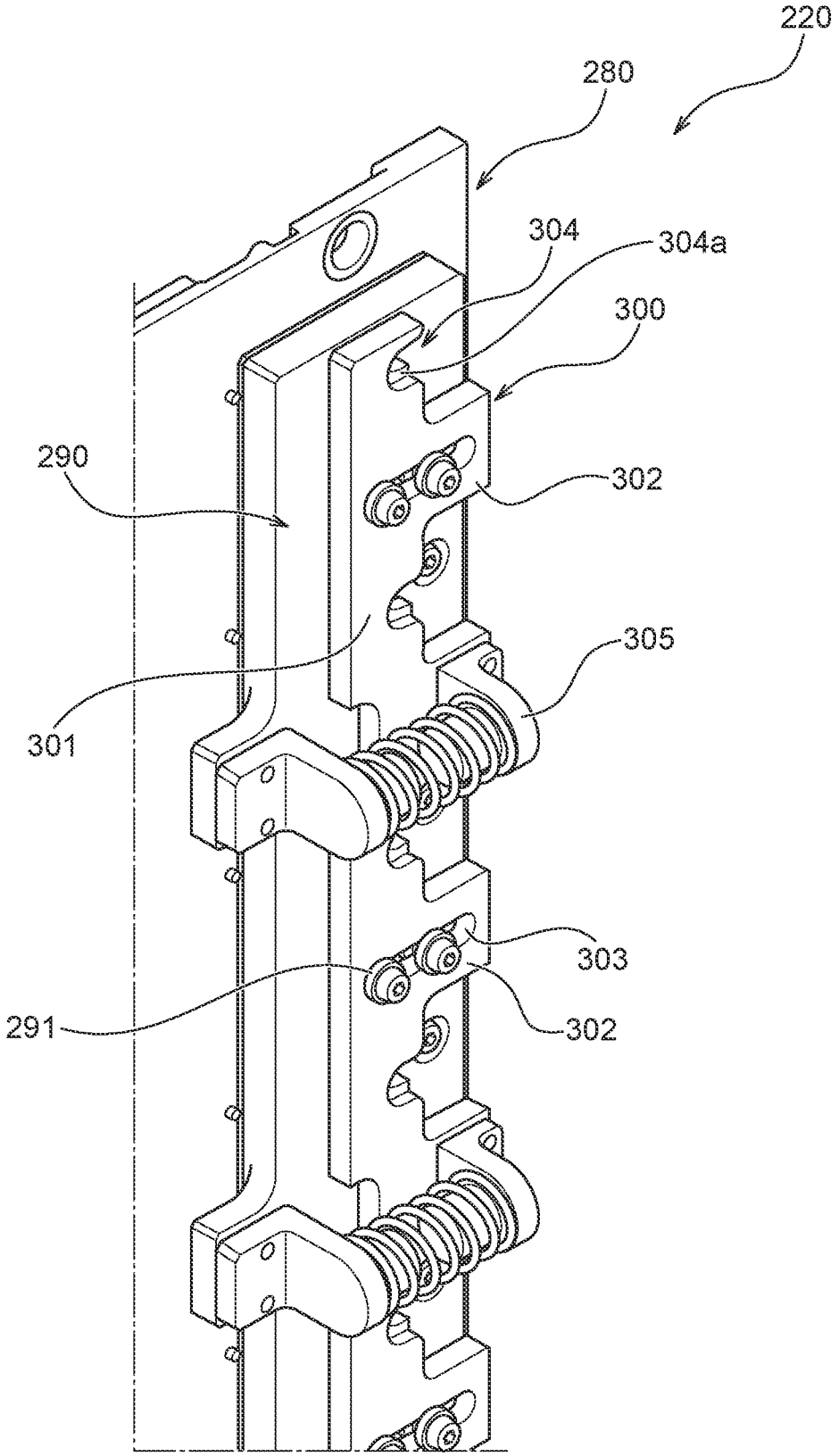
FIG. 12 is a perspective view illustrating close-up of the vicinity of a locking mechanism of the second holding member.
Figure 13:
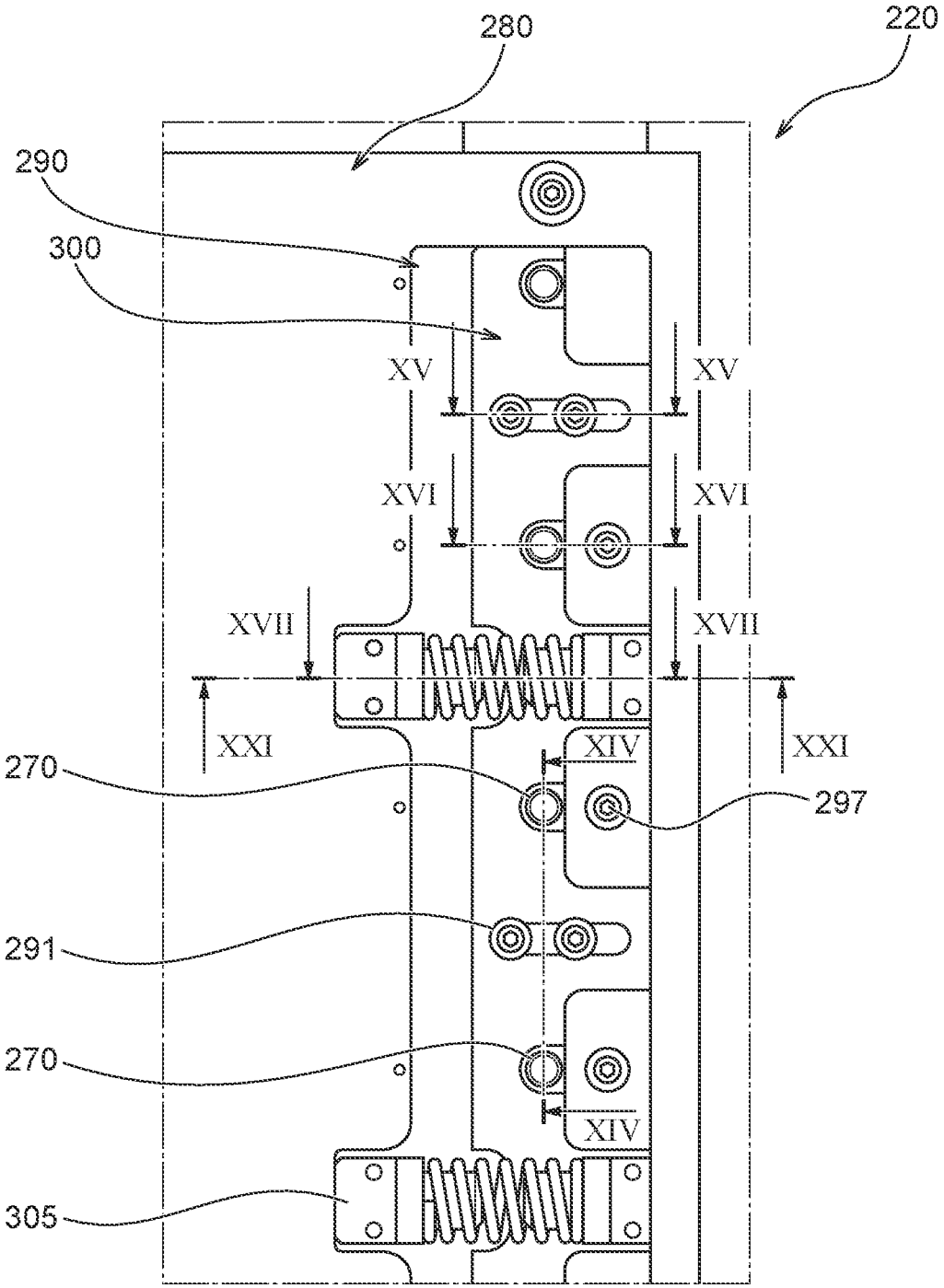
FIG. 13 is a back view illustrating close-up of the vicinity of the locking mechanism of the second holding member.
Figure 14:
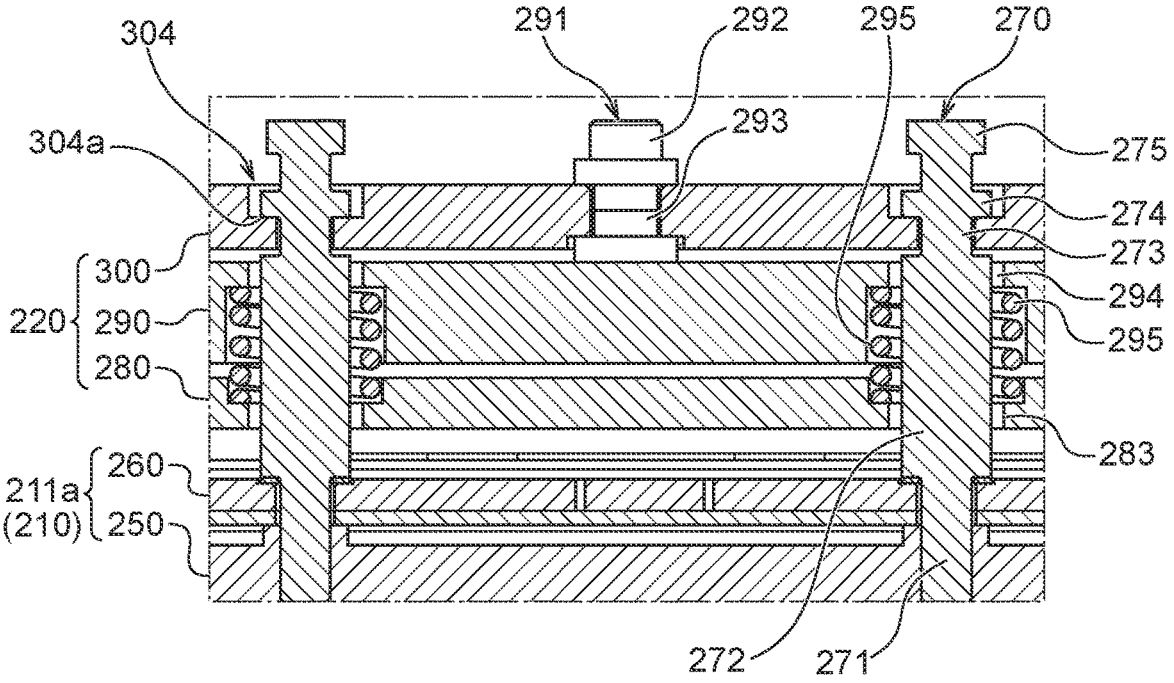
FIG. 14 is a sectional view taken along a line XIV-XIV in FIG. 13 in a locked state.
Figure 15:
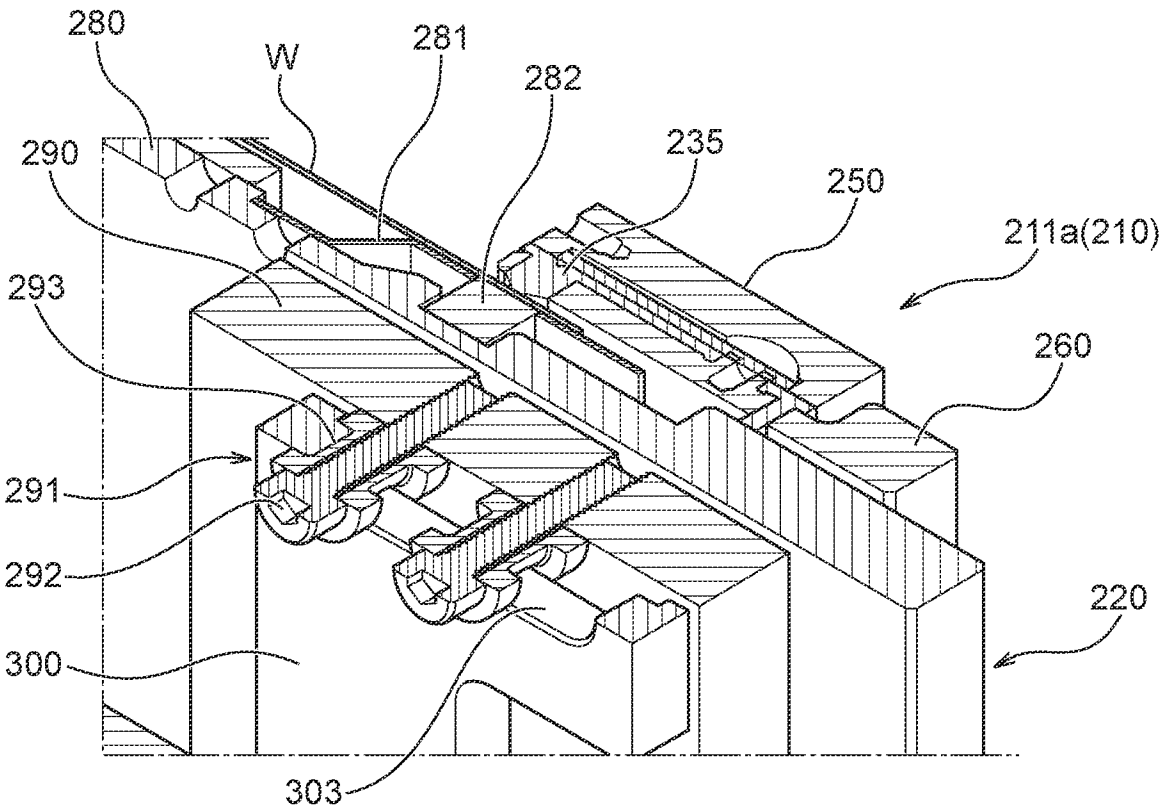
FIG. 15 is a sectional perspective view taken along a line XV-XV in FIG. 13 in the locked state.
Figure 16:
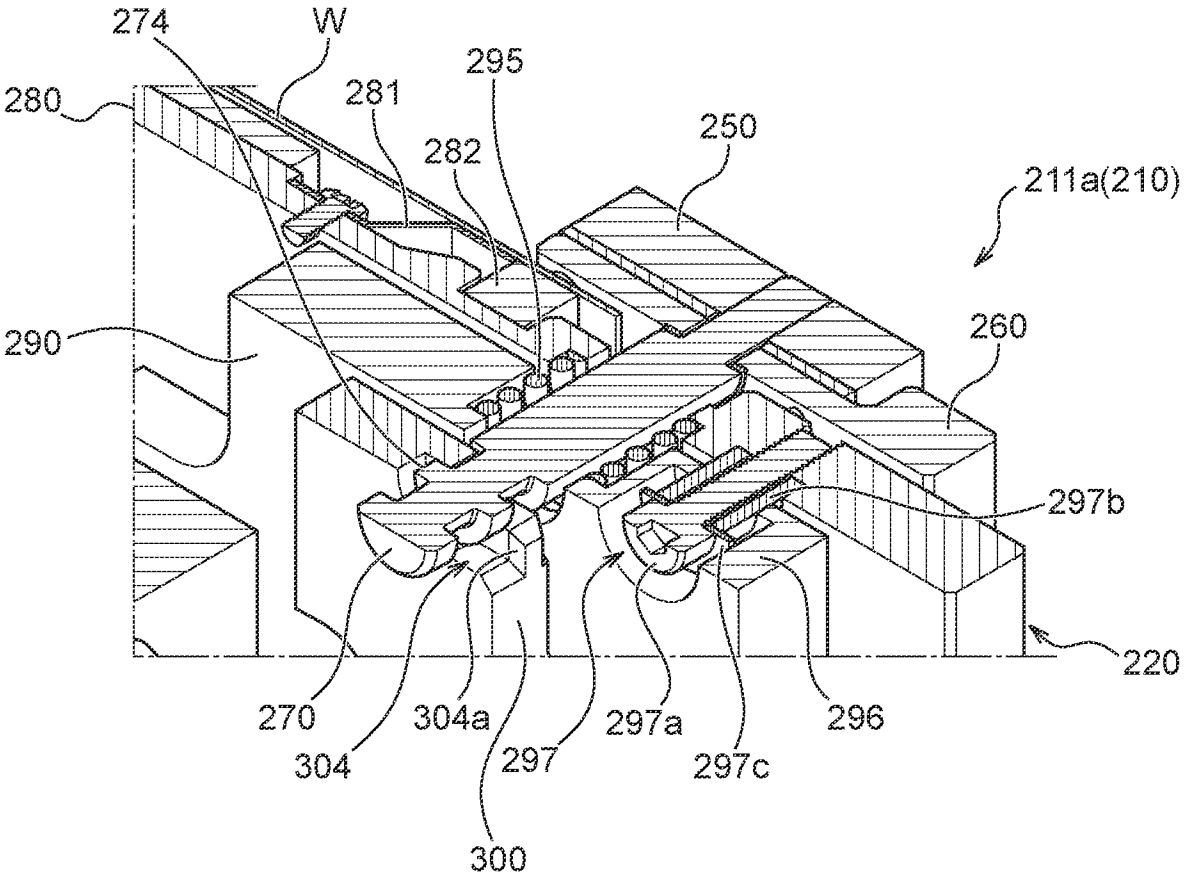
FIG. 16 is a sectional perspective view taken along a line XVI-XVI in FIG. 13 in the locked state.
Figure 17:
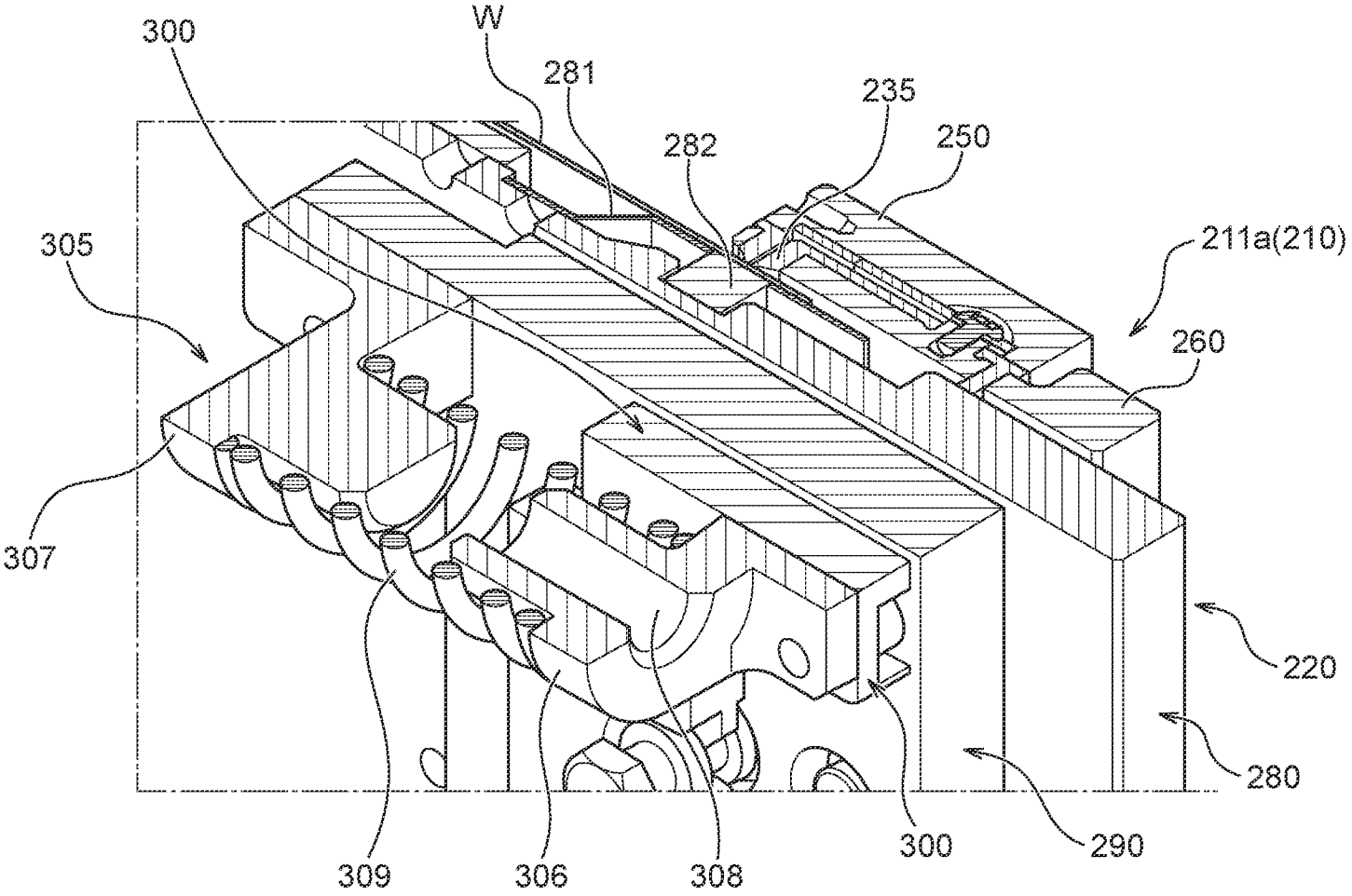
FIG. 17 is a sectional perspective view taken along a line XVII-XVII in FIG. 13 in the locked state.

FIG. 12 is a perspective view illustrating close-up of the vicinity of the locking mechanism of the second holding member. FIG. 13 is a back view illustrating close-up of the vicinity of the locking mechanism of the second holding member. FIG. 14 is a sectional view taken along a line XIV-XIV in FIG. 13 in a locked state. FIG. 15 is a sectional perspective view taken along a line XV-XV in FIG. 13 in the locked state. FIG. 16 is a sectional perspective view taken along a line XVI-XVI in FIG. 13 in the locked state. FIG. 17 is a sectional perspective view taken along a line XVII-XVII in FIG. 13 in the locked state.

The second holding member 220 includes the back plate 280, the float plates 290 provided to be movable closer to and away from the back plate 280, and the lock plates 300 provided to be slidable relative to the float plates 290 in an in-plane direction.

(Back Plate)

As shown in FIGS. 2 to 4, the back plate 280 is formed to have the dimensions and the shape to cover the substrate W and the parts of the longitudinal members 211*a* and 211*b* corresponding to the substrate W. As shown in FIG. 17, a substrate support plate 281 and a shock absorber 282 are provided on the first holding member 210-side of the back plate 280. The substrate support plate 281 is a single end-support (partially both end-support) plate member and is provided in a position corresponding to the outer circumferential part of the substrate W. The substrate support plate 281 is configured such that the shock absorber 282 is held between the back plate 280 and the substrate support plate 281. The substrate support plate 281 works in cooperation with the shock absorber 282 to buffer the pressing force and to absorb a difference in thickness of the substrate (a thin substrate or a thick substrate) and warpage of the substrate. The shock absorber 282 is provided at a position corresponding to the seal portion 235 of the first holding member 210 and serves to buffer the pressing force received from the seal portion 235 and to absorb the difference in thickness of the substrate (the thin substrate or the thick substrate) and warpage of the substrate when the substrate is held by the substrate holder 200.

(Float Plate)

As shown in FIG. 4, the float plates 290 are provided on respective sides of the back face of the back plate 280 along a left side and a right side of the substrate W corresponding to the longitudinal members 211*a* and 211*b* of the first holding member 210. A spring 295 is provided between the back plate 280 and the float plate 290 as shown in FIG. 14 and is configured to press the back plate 280 and the float plate 290 in directions away from each other. More specifically, the lock plate 300 is placed on one end of the spring 295 via the float plate 290, and the back plate 280 is placed on the other end of the spring 295. In other words, the spring 295 is provided between the lock plate 300 and the back plate 280 and is configured to press the lock plate 300 and the back plate 280 in the directions away from each other. The plurality of pins 270 are lock pins configured to lock the lock plate 300 and thereby lock the second holding member 220 to the first holding member 210. When the second holding member 220 is mounted to the first holding member 210, the pins 270 of the first holding member 210 penetrate inside of the springs 295 of the second holding member 220, pass through the back plate 280 and the float plates 290, and are locked to locking portions 304 of the lock plates 300. In this state, the spring 295 is compressed to press the float plate 290 (the lock plate 300) and the back plate 280 such as to be separated from each other. This causes the back plate 280 to be pressed against the first holding member 210 and causes the substrate W to be pressed against the seal portion 235 by the back plate 280 when the substrate W is held.

As shown in FIG. 14, the back plate 280 has through holes 283 formed to cause the pins 270 to pass through, and the float plate 290 has through holes 294 formed to cause the pins 270 to pass through. The through hole 283 and the through hole 294 are provided at corresponding positions. The through hole 283 and the through hole 294 respectively have large diameter portions provided on the respective sides facing each other to place the spring 295 therein. These large diameter portions form a space to place the spring 295 therein. One end of the spring 295 abuts against a step at a boundary between the large diameter portion and a small diameter portion of the through hole 283, and the other end of the spring 295 abuts against a step at a boundary between the large diameter portion and a small diameter portion of the through hole 294. This configuration causes the spring 295 to press the back plate 280 and the float plate 290 (the lock plate 300) in the directions away from each other.

As shown in FIG. 13 and FIG. 16, a plurality of guide pins 297 serve to fix the position of the float plate 290 in the in-plane direction relative to the back plate 280. The float plate 290 is configured to be guided by the guide pins 297 and moved closer to and away from the back plate 280. The guide pin 297 includes a pin 297*a*, a sleeve 297*b* and a stopper 297*c*. The pin 297*a* is configured to pass through a through hole provided in a bottom face of a recess 296 of the float plate 29) and to be fixed to the back plate 280 and is arranged such that its head is placed in the recess 296 of the float plate 290. The sleeve 297 is placed around the pin 297*a* and is arranged such that the float plate 290 is guided in its axial direction along the outer circumference of the sleeve 297*b*. The stopper 297*c* is placed between the head of the pin 297*a* and the sleeve 297. The stopper 297 is configured to abut against the bottom face of the recess 296 and to restrict the moving range of the float plate 290 away from the back plate 280.

As shown in FIG. 14, the pin 270 includes a leading end portion 271 that is fixed to (screwed to according to this embodiment) the first holding member 210, a middle portion 272 that has a larger diameter than the diameter of the leading end portion 271 and that passes through the back plate 280 and the float plate 290, a base end portion 273 that has a smaller diameter than the diameter of the middle portion 272, a flange 274 that is provided in the middle of the base end portion 273, and a flange 275 that is provided at an edge of the base end portion 273. The flange 274 constitutes a first locked portion to lock the substrate holder 200 in the state that the substrate is held. The flange 275 constitutes a second locked portion to semi-lock the substrate holder 200 in the state that the substrate is not held. The semi-locked state causes no load to be applied to the seal portion, for example, during storage of the substrate holder 200. FIG. 14 illustrates the locked state that the lock plate 300 is locked to the flange 274 of the pin 270 and that the substrate is held between the first holding member 210 and the second holding member 220.

(Lock Plate)

As shown in FIG. 4 and FIG. 12, the lock plates 300 are provided along the left side and the right side of the substrate W on the back faces of the float plates 290 corresponding to the longitudinal members 211*a* and 211*b* of the first holding member 210. The lock plate 300 includes a base end portion 301, guide portions 302, guide grooves 303 provided in the guide portions 302, locking portions 304 provided in the base end portion 301, and biasing mechanisms 305. The base end portion 301 is formed in a long shape corresponding to the longitudinal member 211*a* of the first holding member 210 and is provided with a plurality of locking portions 304 along a longitudinal direction thereof to be engaged with the plurality of pins 270 of the first holding member 210. The locking portion 304 is provided to be engageable with the flange 274 or the flange 275 of the pin 270 as shown in FIG. 14. As shown in FIG. 12, the locking portion 304 is formed in a shape substantially corresponding to part of the circumferences (for example, half circumferences) of the flanges 274 and 275 of the pin 270 and has a step 304*a* that abuts against the bottom face of the flange 274 or the flange 275.

As shown in FIG. 12, the guide portion 302 is extended from the base end portion 301 in a direction crossing the longitudinal direction (transverse direction) and has the guide groove 303 in a long hole shape extended in the transverse direction. According to the embodiment, the guide groove 303 is extended in a direction perpendicular to the longitudinal direction and is formed to penetrate the thickness of the guide portion 302. As shown in FIG. 15, two guide pins 291 are engaged in the guide groove 303. The guide groove 303 is configured such that the lock plate 30) is guided by these guide pins 291 and is moved on the float plate 290 in a transverse direction relative to the float plate 290. The guide pin 291 includes a pin 292 that is fixed to the float plate 290 and a sleeve 293 that is mounted to the outer circumference of a base end portion of the pin 292 and has flanges on respective ends. The lock plate 300 is engaged between the flanges on the respective sides of the sleeve 293. The flanges on the respective sides serve to define or fix the distance between the float plate 290 and the lock plate 300. When the float plate 290 is moved by the spring 295 (shown in FIG. 14) in a direction away from the back plate 180, this configuration causes the lock plate 300 to move along with the float plate 290 in the direction away from the back plate 280. When the lock plate 3M) and/or the float plate 290 is moved against the biasing force of the spring 295 in a direction closer to the back plate 280, this configuration causes the float plate 290 along with the lock plate 300 to move in the direction closer to the back plate 280.

Figure 24:
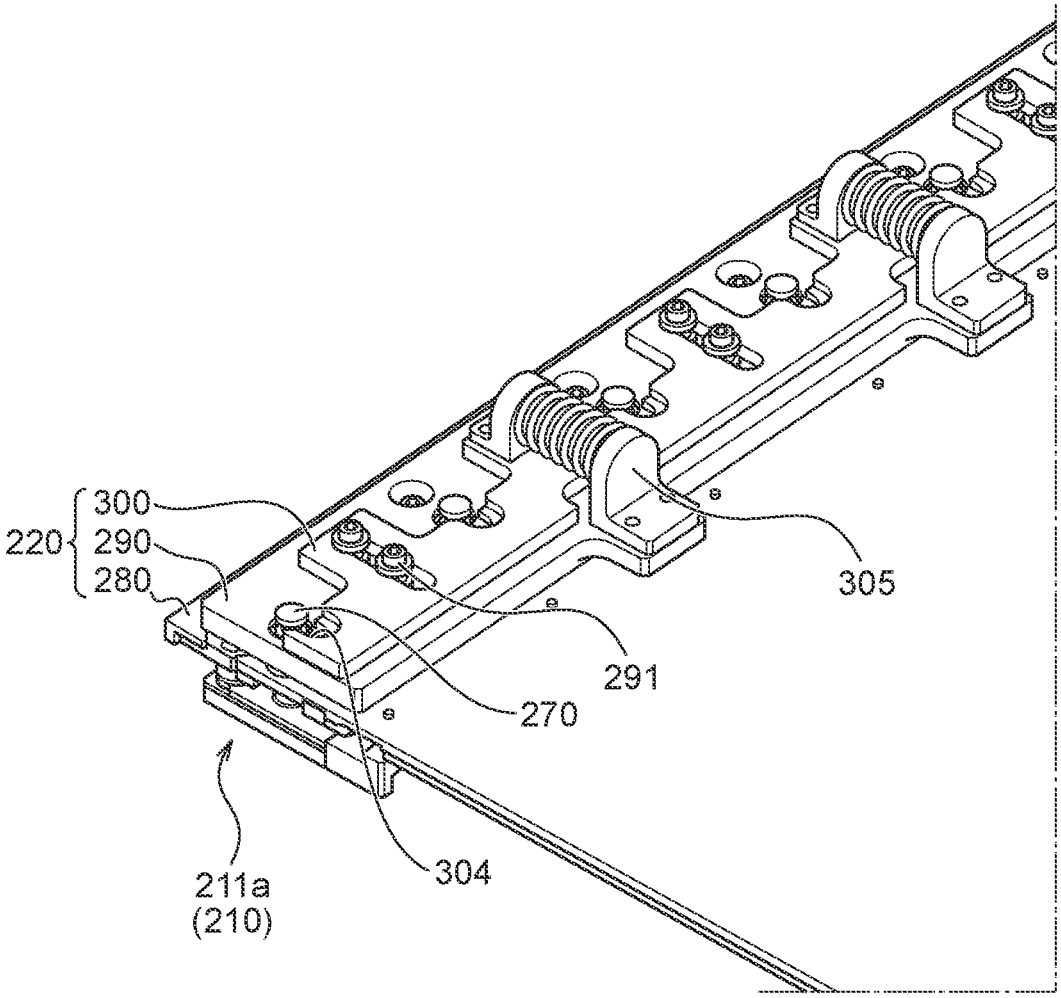
FIG. 24 is an explanatory diagram illustrating the method of mounting the substrate to the substrate holder.

As shown in FIG. 17, the biasing mechanism 305 includes a spring 309 that is placed between a spring bearing 306 fixe to the lock plate 300 and a spring bearing 307 fixed to the float plate 290. The spring bearing 306 may be provided with an engagement hole 308 to allow for engagement of a jig that is used to move the spring bearing 306. The spring 309 serves to press the lock plate 300 against the float plate 290 in a direction that causes the locking portion 304 to engage with the pin 270 (outward). When the lock plate 300 is moved inward relative to the float plate 290 against the biasing force of the spring 309, the locking portion 304 of the lock plate 300 is separated from the pin 270, and the lock plate 300 is unlocked and released from the pin 270 (as shown in FIG. 24).

(Semi-Locking)

Figure 18:
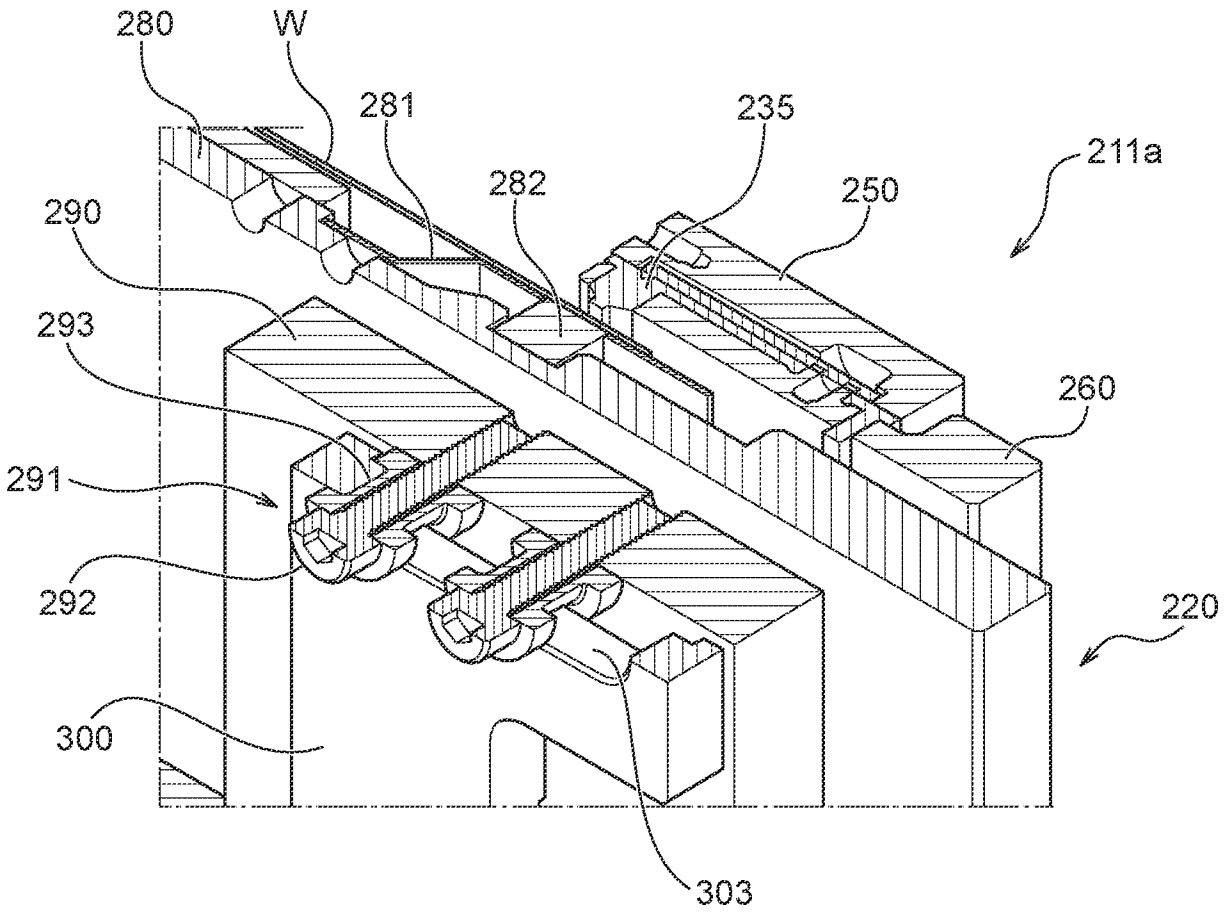
FIG. 18 is a sectional perspective view corresponding to FIG. 15 in a semi-locked state.
Figure 19:
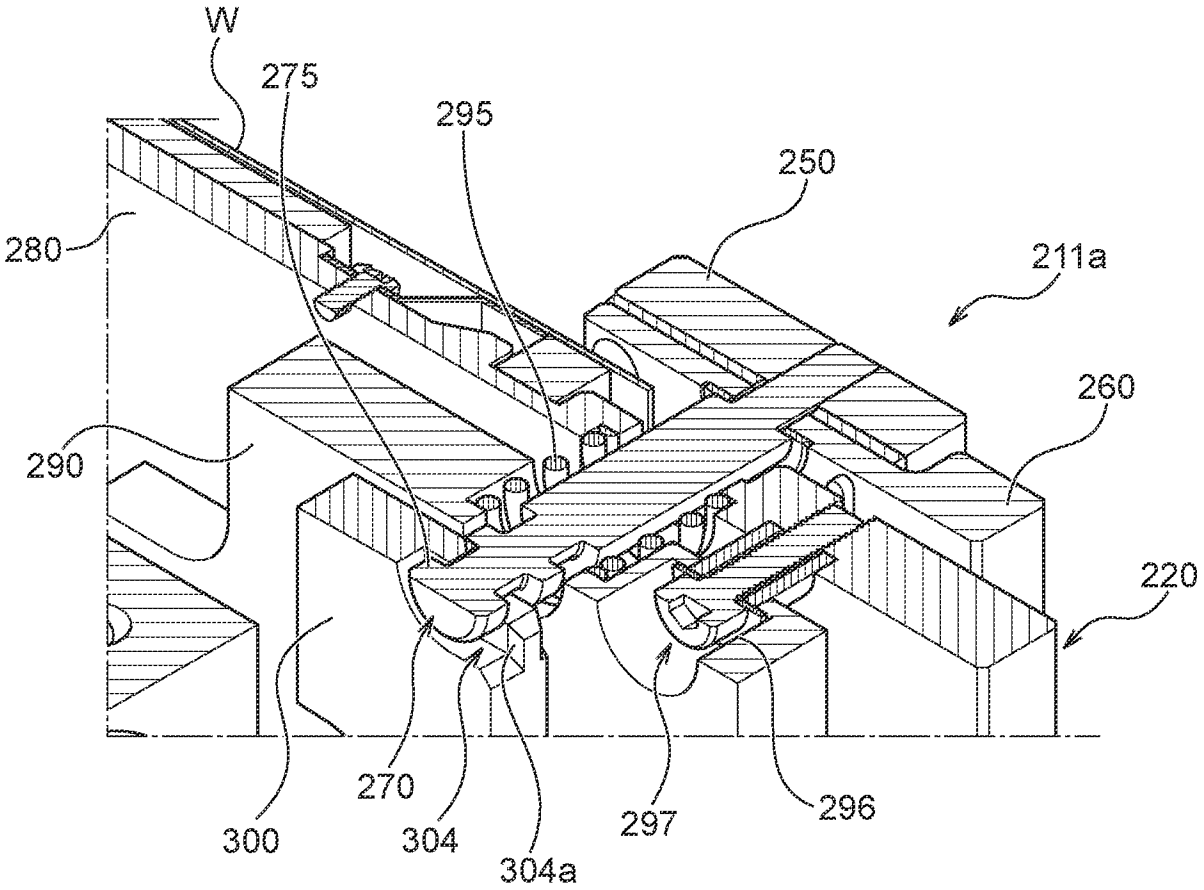
FIG. 19 is a sectional perspective view corresponding to FIG. 16 in the semi-locked state.
Figure 20:
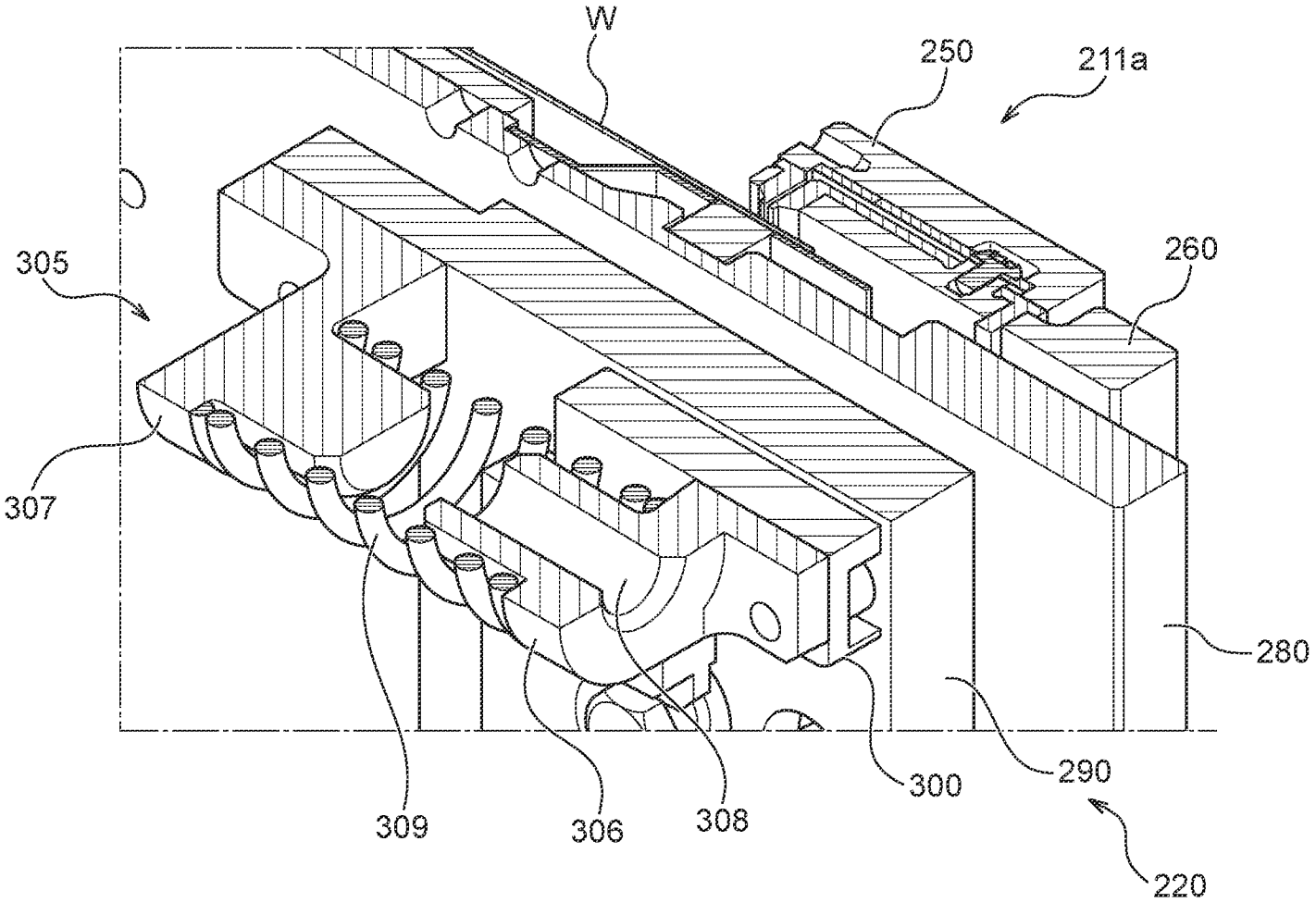
FIG. 20 is a sectional perspective view corresponding to FIG. 17 in the semi-locked state.

FIG. 18 is a sectional perspective view corresponding to FIG. 15 in the semi-locked state. FIG. 19 is a sectional perspective view corresponding to FIG. 16 in the semi-locked state. FIG. 20 is a sectional perspective view corresponding to FIG. 17 in the semi-locked state. The semi-locked state denotes a state that engages the substrate holder 200 without holding the substrate, for example, during storage of the substrate holder 200. In the semi-locked state, the substrate holder 200 does not hold the substrate, and the first holding member 210 and the second holding member 220 are engaged with each other with applying no load to the seal portion 235. As shown in FIG. 19, in the semi-locked state, the locking portion 304 of the lock plate 300 is engaged with the flange 275 at the end of the pin 270. This semi-locked state increases the distance between the first holding member 210 and the second holding member 220, compared with the distance in the locked state. As shown in FIGS. 18 to 20, this configuration enables the substrate holder 200 to be engaged in the state that the seal portion 235 is not in contact with the second holding member 220.

(Local Seal Structure)

Figure 21:
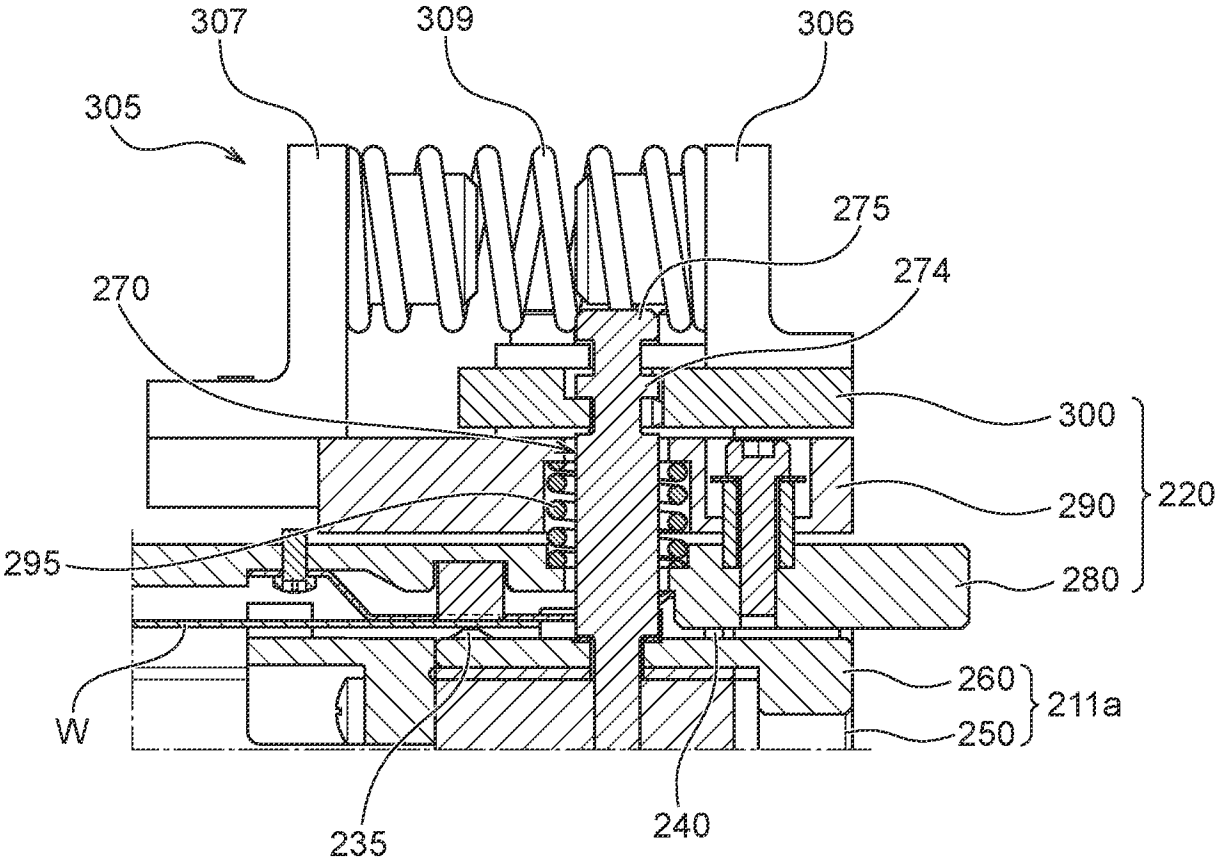
FIG. 21 is a sectional view taken along a line XXI-XXI in FIG. 13.

FIG. 21 is a sectional view taken along a line XXI-XXI in FIG. 13. As shown in FIG. 21, the pin 270 and the spring 295 are provided in the vicinity of the seal portion 235 along the outer circumference of the substrate W (along the left side and the right side of the substrate W in this illustrated example). This configuration accordingly enables the force of the pin 270 and the spring 295 pressing the substrate W via the back plate 280 to be transmitted to the seal portion 235 directly and by a short transmission pathway. This reduces a load applied to the substrate W by the pressing force of the pin 270 and the spring 295. As a result, this configuration applies an appropriate pressing force to the seal portion 235 to seal the substrate contact 233, while reducing the load applied to the substrate W. This configuration is especially effective for a large-sized substrate. In some cases, it may be difficult to apply a uniform force to the seal portion 235 over a long length of the large-sized substrate. On the other hand, the configuration of this embodiment implements a local seal structure that enables the force of the pin 270 and the spring 295 pressing the substrate W via the back plate 280 to be transmitted to the seal portion 235 directly and by the short transmission pathway, whereby to appropriately seal the seal portion 235 over the long distance, while reducing the load applied to the substrate W.

Furthermore, the protrusion 240 of the seal member 231 is configured such that the pin 270 and the spring 295 are placed between the protrusion 240 and the seal portion 235 in an outward direction of the substrate W. The outward direction of a substrate indicates a direction that is perpendicular to a side of the substrate or to a tangent of a periphery of the substrate and goes outward. In the case of a circular substrate, the outward direction denotes outward in a radial direction. In the case of a polygonal substrate, the outward direction denotes a direction that is perpendicular to a side and goes outward. This configuration causes the seal portion 235 and the protrusion 240 to serve as a pressure receiver that receives the pressing force of the pin 270 and the spring 295. This establishes a local seal configuration or structure that effectively applies an appropriate biasing force to the seal portion 235 as a place to supply the power and to seal and further suppresses a load due to the biasing force from being applied to the entire substrate. The pressing force of the pin 270 and the spring 295 is received by the seal portion 235 on the inside of the pin 270 and the spring 295 and is received by the protrusion 240 on the outside of the pin 270 and the spring 295. This is unlikely to cause deformation of the first holding member 210 (the longitudinal members 211*a* and 211*b*). Furthermore, the seal portion 235 and the protrusion 240 are respectively placed in the form of a plurality of divisions along a side of the substrate. This configuration thus ensures an appropriate seal pressure required to protect the substrate contact 233 from the plating solution. A known configuration of a conventional substrate holder uses an integral seal member provided along to be in contact with a side of the substrate holder. In some cases, however, it is difficult for the integral seal member to generate a uniform seal pressure along the side of the substrate. An excessive seal pressure is likely to be generated and to damage the substrate in some cases.

Moreover, the seal member 231 is provided in the form of modules as a plurality of divisions (as shown in FIG. 7). Accordingly, the local seal structure achieved by the localized biasing force of a plurality of pins 270 and a plurality of springs 295 locally provided along the outer circumferential part of the substrate W cooperates with the local seal structure that seals the substrate contact 233 by means of the seal portion 235 with respect to each of the power feed modules to achieve a more localized seal. This further enhances the adaptability to the large-sized substrate.

(Modifications)

Figure 22:
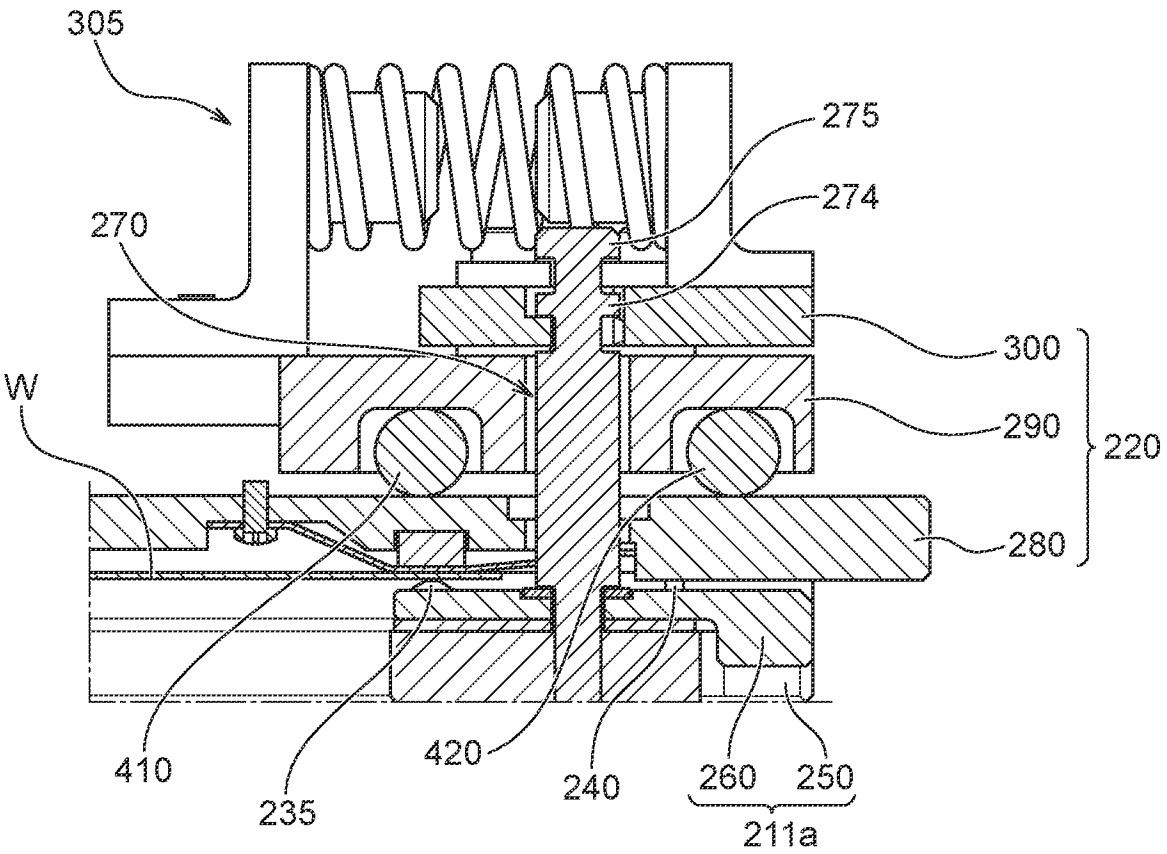
FIG. 22 is a sectional view illustrating a substrate holder according to a modification.

FIG. 22 is a sectional view illustrating a substrate holder according to a modification and is a sectional view corresponding to FIG. 21. As shown in FIG. 22, the spring 295 may be replaced by elastic elements 410 and 420. The elastic elements 410 and 420 are provided respectively inside and outside of the pin 270 between the float plate 290 and the back plate 280 along the outer circumference of the substrate (along the left side and the right side of the substrate in this illustrated example). The elastic elements 410 and 420 are sequentially placed along the longitudinal direction of each of the longitudinal members 211*a* and 211*b* of the first holding member 210. In the illustrated example, the elastic element 410 is placed at a position overlapping the seal portion 235. In another example, both the elastic elements 410 and 420 may be arranged to be located outside of the substrate W. The elastic elements 410 and 420 may be provided in rod-like shapes, for example, obtained by cutting O-rings. The elastic elements 410 and 420 employed may be elastic elements made of any material such as a rubber or a resin and formed in any shape such as a rod-like shape or a tubular shape.

Each of the elastic elements 410 and 420 may be configured by aligning a plurality of pieces. The elastic elements 410 and 420 may be formed as an integrated ring-shaped member. According to a modification, an elastic element may be provided along the entire circumference of the substrate. In this case, the elastic element may be formed in an integral shape along the entire circumference of the substrate or may be comprised of multiple pieces. For example, a ring-shaped elastic element (formed in an integral shape or as multiple pieces) may be provided inside of the pin 270 to surround the entire circumference of the substrate and a rig-shaped elastic element (formed in an integral shape or as multiple pieces) may be provided outside of the pin 270 to surround the entire circumference of the substrate. In another example, the elastic elements 410 and 420 may be provided as an integral body, for example, an O-ring, to surround the individual pins 270.

(Method of Mounting and Demounting Substrate)

Figure 23:
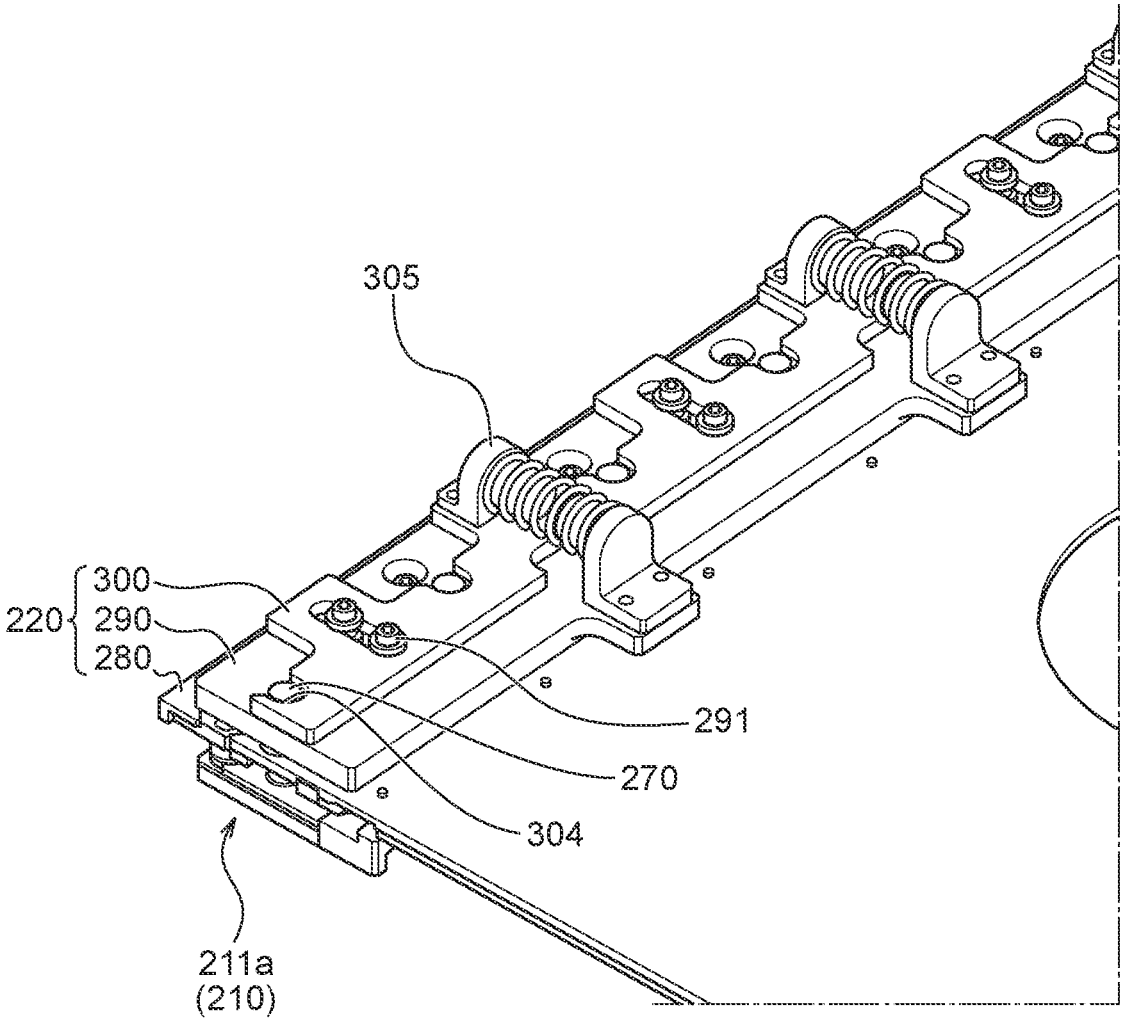
FIG. 23 is an explanatory diagram illustrating a method of mounting a substrate to the substrate holder.
Figure 25:
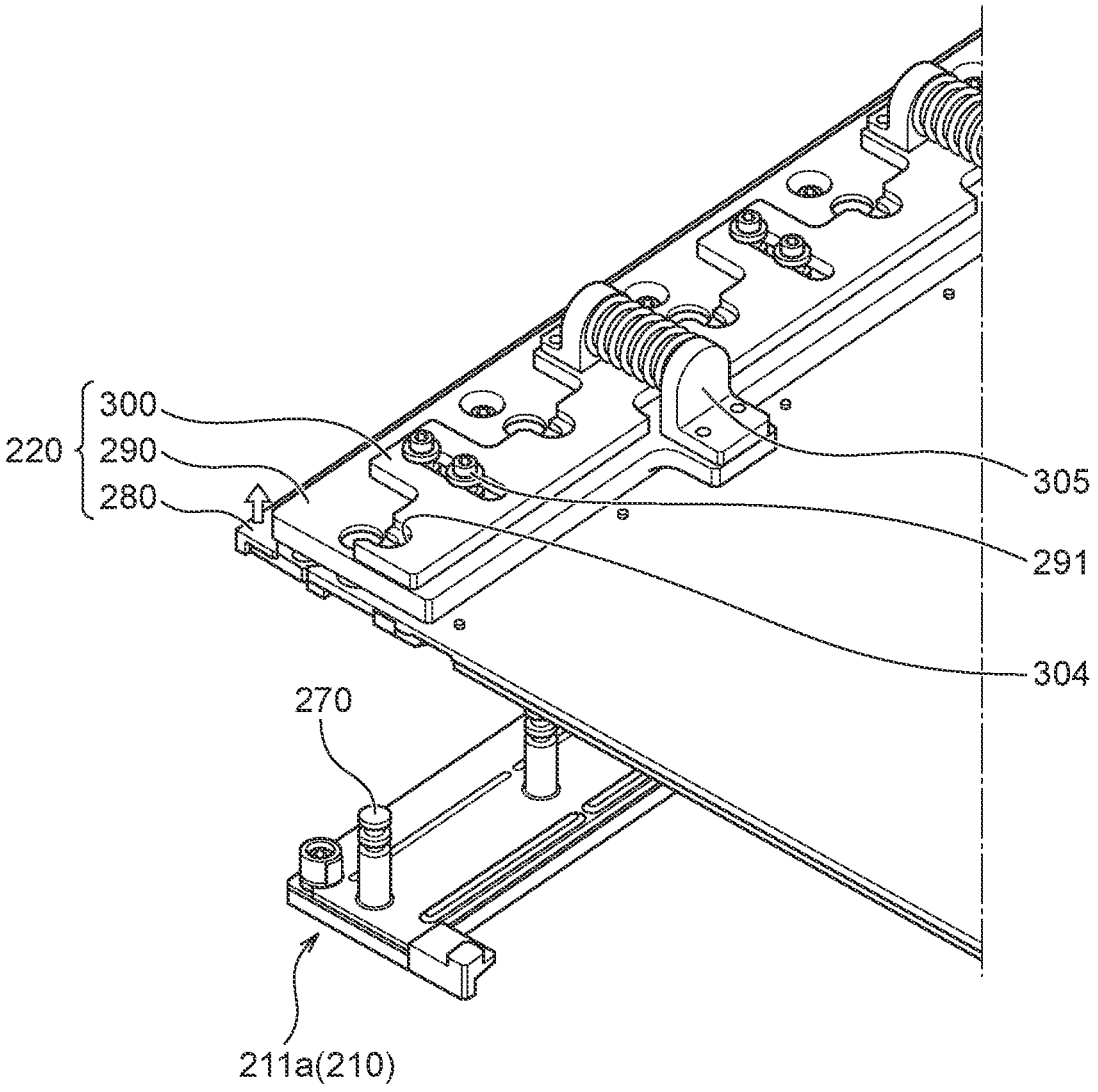
FIG. 25 is an explanatory diagram illustrating the method of mounting the substrate to the substrate holder.
Figure 26:
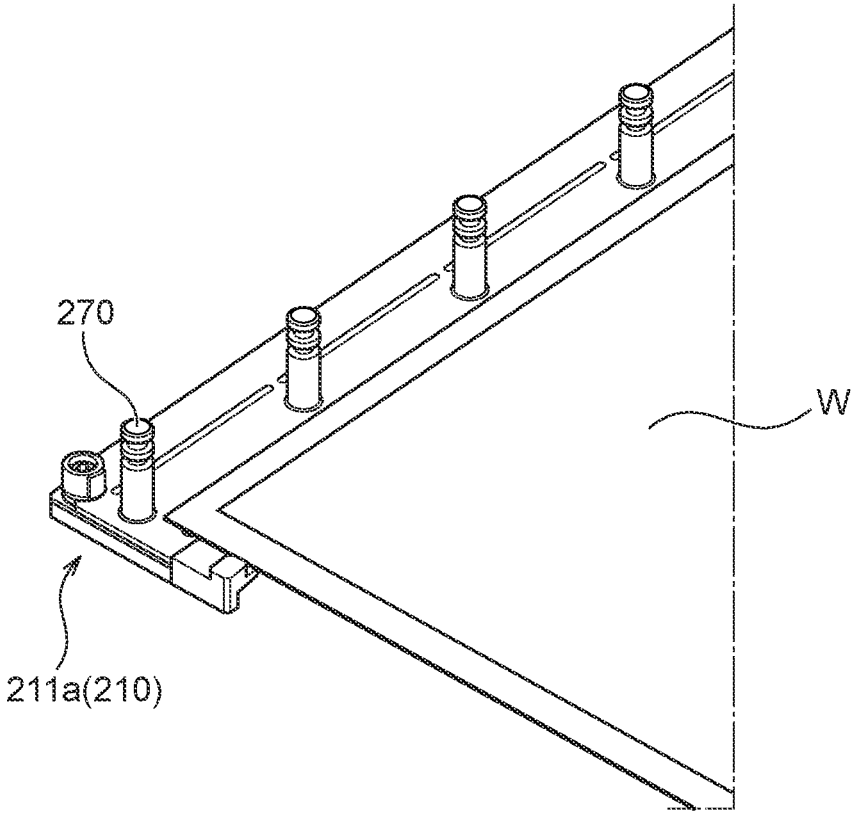
FIG. 26 is an explanatory diagram illustrating the method of mounting the substrate to the substrate holder.

FIGS. 23 to 26 are explanatory diagrams illustrating a method of mounting the substrate to the substrate holder. FIG. 23 illustrates the substrate holder 200 in the state that the substrate is not held (for example, in the semi-locked state). From this state of FIG. 23, the lock plate 300 is slid inward relative to the float plate 290 to compress the springs 309 of the biasing mechanisms 305 and release the locking portions 304 of the lock plate 300 from the pins 270 as shown in FIG. 24. The second holding member 220 is subsequently detached from the first holding member 210 as shown in FIG. 25, and the substrate W is placed on the first holding member 210 as shown in FIG. 26. The second holding member 220 with the springs of the biasing mechanisms 305 in the compressed state is then placed on the longitudinal members 211*a* and 211*b* of the first holding member 210 with the substrate W placed thereon like the state of FIG. 24 (with the substrate W placed in FIG. 24). The float plate 290 (and/or the lock plate 300) is subsequently pressed down toward the back plate 280 to adjust the height of the locking portions 304 of the lock plate 300 such as to be engageable with the flanges 274 of the pins 270 (shown in FIG. 14). The locking portions 304 of the lock plate 300 are then engaged with the flanges 274 of the pins 270 by releasing the compression of the springs of the biasing mechanisms 305. This causes the substrate W to be held in the locked state by the substrate holder 200.

A procedure of demounting the substrate slides the lock plate 300 inward relative to the float plate 290 such as to compress the springs 309 of the biasing mechanisms 305 of the substrate holder 200 with the substrate held thereby and releases the locking portions 304 of the lock plate 300 from the pins 270 (as shown in FIG. 24, with the substrate placed in FIG. 24). The second holding member 220 is subsequently detached from the first holding member 210 (as shown in FIG. 25), and the substrate W is demounted from the first holding member 210. The second holding member 220 with the springs of the biasing mechanisms 305 in the compressed state is then placed on the longitudinal members 211*a* and 211*b* of the first holding member 210 without the substrate (like FIG. 24). The float plate 290 (and/or the lock plate 300) is subsequently pressed down toward the back plate 280 to adjust the height of the locking portions 304 of the lock plate 300 such as to be engageable with the flanges 275 of the pins 270 (shown in FIG. 14). The locking portions 304 of the lock plate 300 are then engaged with the flanges 275 of the pins 270 by releasing the compression of the springs of the biasing mechanisms 305. This causes the substrate holder 200 to be in the semi-locked state.

Other Embodiments (1) According to the embodiment described above, the substrate holder 200 is provided with the power feed devices along the two sides of the substrate W. According to another embodiment, the substrate holder 200 may be provided with power feed devices along the entire circumference of the substrate W.

(2) The configuration of providing the seal members 231 and the substrate contacts 233 in the form of multiple modules may be applied to a substrate holder for both-side plating. For example, a plurality of modules (power feed modules) including the seal members 231 and the substrate contacts 233 may be placed on both the first holding member and the second holding member.

(3) The above embodiment describes the locking mechanism (the pins 270, the lock plate 300 and the biasing mechanism (the spring 295 or the elastic elements 410 and 420)) of the substrate holder 200, along with the seal member 231 in the form of the modules. The locking mechanism described above may be used for a conventional continuous integral seal or other any seals.

Figure 28:
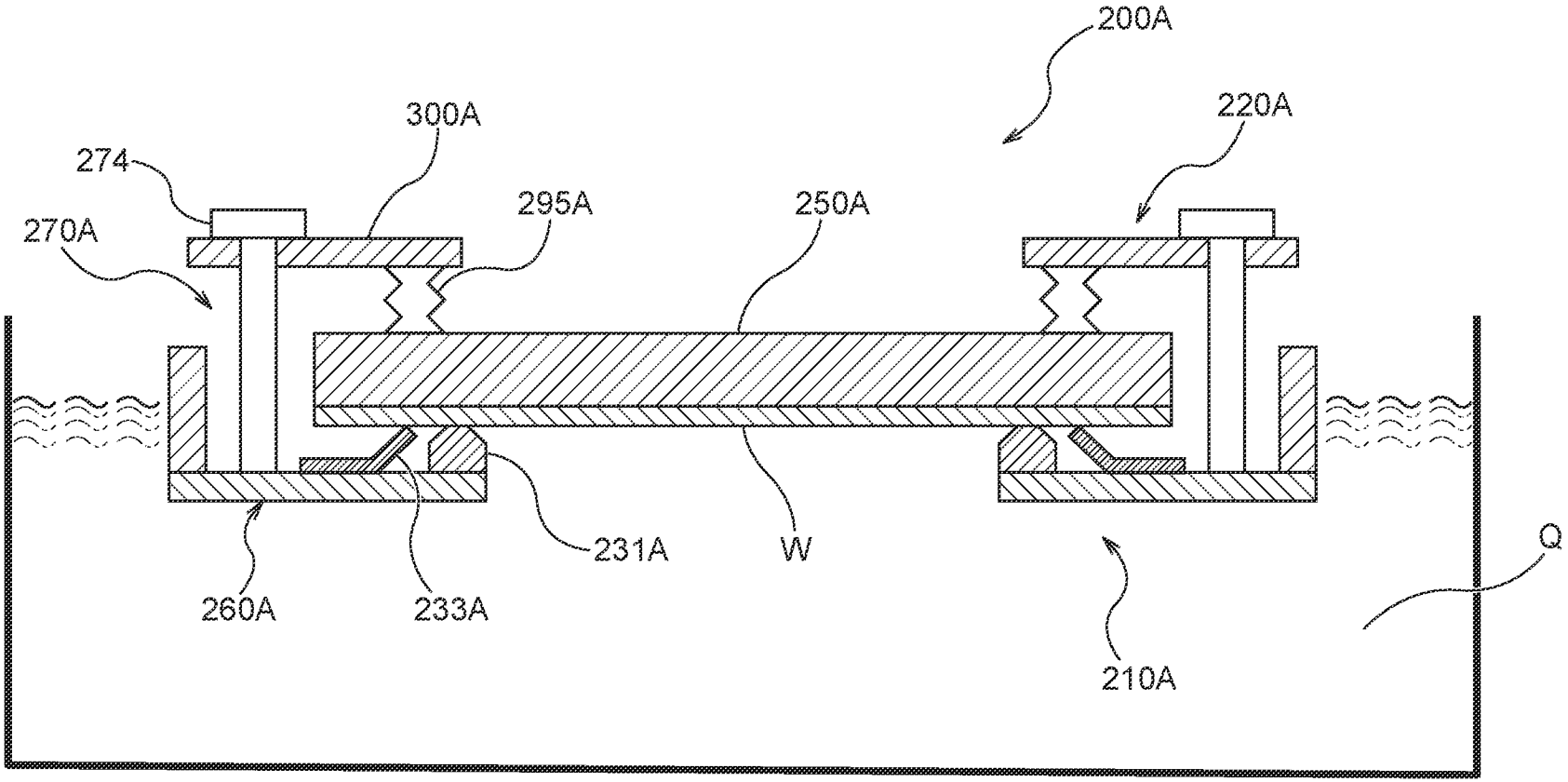
FIG. 28 is a schematic diagram illustrating an example of a substrate holder with the locking mechanism of the above embodiment applied to a continuous integral seal.

FIG. 28 is a schematic diagram illustrating an example of a substrate holder with the locking mechanism of the above embodiment applied to a continuous integral seal. This substrate holder 200A is a face-down-type substrate holder and is used in a plating method (cup-type or cup-shaped plating method) that causes a surface to be plated (a plating surface) of a substrate W to be faced down and exposed to a plating solution Q. A first holding member 210A includes holder bodies 260A such as bus bars, pins 270A fixed to the holder body 260A, and substrate contacts 233A and seal members 231A held on the holder bodies 260A. The pin 270A has a flange 274 similar to the flange 274 of the embodiment described above. The pin 270A may be provided with a flange 275 for semi-locking, in addition to the flange 274. In this example, the seal member 231A is provided inside of the substrate contact 233A in the plane of the substrate W. No seal member is provided outside of the substrate contact 233A. An external seal member configured to externally protect the substrate contact 233A (for example, a seal member configured to seal between a second holding member 220A and the holder body 260A) may, however, be further provided on a needed basis according to the attitude of the substrate holder 200A in a plating device. The second holding member 220A includes a first plate 250A, locking members 300A, and biasing members (springs or elastic elements) 295A placed between the first plate 250A and the locking members 300A and fixed to both the first plate 250A and the locking members 300A. The second holding member 220A is laid over the first holding member 210A with the substrate W placed thereon, and the locking members 300A of the second holding member 220A are locked by the pins 270A of the first holding member 210A. This compresses the biasing members 295A and causes the biasing members 295A to press the first plate 250A and the substrate W against the seal members 231A in the vicinity of the pins 270A. This configuration has similar functions and advantageous effects to those of the pins and the biasing members (elastic elements) described above. The configuration illustrated in FIG. 28 does not include float plates but may be provided additionally with float plates like the configuration of the embodiment described above (shown in FIG. 12 to FIG. 22). On the contrary, the float plates may be omitted from the configuration of the embodiment described above (shown in FIG. 12 to FIG. 22).

(4) According to the embodiment described above, the plurality of substrate contact 233 are attached to the bus bar 260. According to another embodiment, one substrate contact (for example, a substrate contact extended over a predetermined length (one side, part of one side, the entire circumference or the like) on the outer circumference of the substrate) may be attached to one bus bar 260.

(5) According to the embodiment described above, the continuous integral front plate is provided along the bus bars. According to another embodiment, individual front plates may be provided corresponding to individual power feed modules. In the latter case, each individual front plate serves in cooperation with the seal member 231 to protect the substrate contact 233 in each of the power feed modules. Accordingly, it may be regarded that each individual front plate is included as part of each individual power feed module. Each individual front plate may be made of the same material as that of the seal member 231.

At least the following aspects are provided from the embodiments described above.

According to a first aspect, there is provided a substrate holder. The substrate holder comprises a contact assembly provided with a contact configured as an electric contact to come into contact with an outer circumferential part of a first face of a substrate, a seal member provided with a seal portion configured to cover a periphery of a leading end portion of the contact and to come into contact with the first face, and a holder body configured to hold the contact and the seal member; a first plate located on a second face side of the substrate and configured to hold the substrate between the contact assembly and the first plate; at least one first pin fixed to the holder body of the contact assembly, extended toward the second face side on outside of the substrate, and provided with a locked portion; a locking member placed on the second face side relative to the first plate and configured to be changeable or displaceable between a locked state/position and an unlocked state/position with respect to the locked portion of the first pin; and at least one first biasing member placed between the locking member and the first plate along the outer circumferential part of the substrate such as to separate the locking member and the first plate from each other and compressed between the locking member and the first plate in the locked state to bias the first plate toward the contact assembly.

According to this aspect, the first pin and the first biasing member that define a force of biasing the first plate against the contact assembly are provided in the outer circumferential part of the substrate. This configuration enables the biasing force of the first biasing member to be applied directly and by a short transmission pathway to the outer circumferential part of the substrate. This accordingly enables the force of pressing the seal portion to be transmitted from the first biasing member to the substrate directly and by a short transmission pathway. This configuration achieves a local seal structure that applies an appropriate biasing force to any location where the electric power is to be fed/any location to be sealed. The configuration that a plurality of first pins and a plurality of first biasing members (or one or a plurality of first biasing members having a length along the outer circumference of the substrate) are provided along the outer circumferential part of the substrate suppresses a load caused by the biasing force from being applied to the entire substrate. As a result, this configuration enables the seal portion to be pressed and sealed by an appropriate pressing force, while suppressing the load from being applied to the entire substrate.

Moreover, the configuration of this aspect causes the periphery of the leading end portion of the contact (substrate contact) to be covered by the seal member. This configuration effectively seals the substrate contact and keeps the periphery of the leading end portion of the substrate contact dried. Furthermore, the periphery of the leading end portion of the substrate contact is covered by the seal member, so that there is no space or very little space in the periphery of the leading end portion of the substrate contact. This configuration accordingly reduces the entering amount of the plating solution to a very small quantity even when the plating solution slightly enters the periphery of the leading end portion of the substrate contact. This suppresses the bipolar phenomenon that makes the flow of shunt current in a substrate seed layer and suppresses dissolution of the substrate seed layer. Since there is no space or very little space in the periphery of the leading end portion of the substrate contact, there is no air or very little air in the periphery of the leading end portion of the substrate contact. Even when a little amount of the plating solution enters the periphery of the leading end portion of the substrate contact (for example, a through hole of a seal portion), this configuration accordingly suppresses dissolution of the substrate seed layer caused by etching in the vicinity of a gas liquid interface due to the exposure and contact of the plating solution to and with the air (galvanic corrosion by dissolved oxygen concentration gradient).

In a substrate configured to define a distance between two members that are provided to cover the entirety or the whole outer circumference of a substrate by using the two members and a clamp structure provided near to an outer circumference (in the vicinity of the outer circumference) of the two members, all the deformations of the members constituting the substrate holder and the warpage of the substrate are likely to cause a variation in crushing amount of the seal (=seal pressure). The clamp structure provided in the vicinity of the outer circumference of the two members fails to transmit the force of pressing the seal portion directly and by a short transmission pathway and is significantly and adversely affected by, for example, deformations of the members constituting the substrate holder. According to the configuration of this aspect, on the other hand, the sealing force is generated by at least one first pin and at least one first biasing member on the outside of the substrate. This configuration reduces the influence of the deformations of the members constituting the substrate holder on the sealing force. This accordingly enables the force of pressing the seal portion to be transmitted from the first biasing member to the substrate directly and by a short transmission pathway and thereby enables the sealing force to be steadily generated at every arbitrary location where the electric power to be fed/every arbitrary location to be sealed. The configuration that a plurality of first pins and a plurality of first biasing members (or one or a plurality of first biasing members having a length along the outer circumference of the substrate) are provided along the outer circumferential part of the substrate suppresses a load caused by the biasing force from being applied to the entire substrate. As a result, this configuration enables the seal portion to be pressed and sealed by an appropriate pressing force, while suppressing the load from being applied to the entire substrate. Furthermore, this configuration enables an appropriate sealing force to be generated along the warpage of the substrate at every arbitrary location where the electric power to be fed/every arbitrary location to be sealed.

According to a second aspect, there is provided a substrate holder. The substrate holder comprises a contact assembly provided with a contact configured as an electric contact to come into contact with an outer circumferential part of a first face of a substrate, a seal member provided with a seal portion configured to come into contact with the first face on inside of the contact, and a holder body configured to hold the contact and the seal member; a first plate located on a second face side of the substrate and configured to hold the substrate between the contact assembly and the first plate; a plurality of first pins, each being fixed to the holder body of the contact assembly, extended toward the second face side on outside of the substrate, and provided with a locked portion; a locking member placed on the second face side relative to the first plate and configured to be changeable or displaceable between a locked state/position and an unlocked state/position with respect to the locked portion of the first pin; and a plurality of first biasing members provided along the outer circumferential part of the substrate, placed between the locking member and the first plate such as to separate the locking member and the first plate from each other, and compressed between the locking member and the first plate in the locked state to bias the first plate toward the contact assembly.

According to this aspect, the first pins and the first biasing members that define a force of biasing the first plate against the contact assembly are provided in the outer circumferential part of the substrate. This configuration enables the biasing force of the first biasing members to be applied directly and by a short transmission pathway to the outer circumferential part of the substrate. This accordingly enables the force of pressing the seal portion to be transmitted from the first biasing members to the substrate directly and by the short transmission pathway. This configuration achieves a local seal structure that applies an appropriate biasing force to any location where the electric power is to be fed/any location to be sealed. Furthermore, the plurality of first pins and the plurality of first biasing members are provided along the outer circumferential part of the substrate. This configuration suppresses a load caused by the biasing force from being applied to the entire substrate. As a result, this configuration enables the seal portion to be pressed and sealed by an appropriate pressing force, while suppressing the load from being applied to the entire substrate.

In a substrate holder configured to define a distance between two members that are provided to cover the entirety or the whole outer circumference of a substrate by using the two members and a clamp structure provided near to an outer circumference (in the vicinity of the outer circumference) of the two members, all the deformations of the members constituting the substrate holder and the warpage of the substrate are likely to cause a variation in crushing amount of the seal (=seal pressure). The clamp structure provided in the vicinity of the outer circumference of the two members fails to transmit the force of pressing the seal portion directly and by a short transmission pathway and is significantly and adversely affected by, for example, deformations of the members constituting the substrate holder. According to the configuration of this aspect, on the other hand, the sealing force is generated by the plurality of first pins and the plurality of first biasing members on the outside of the substrate. This configuration reduces the influence of the deformations of the members constituting the substrate holder on the sealing force. This accordingly enables the force of pressing the seal portion to be transmitted from the first biasing members to the substrate directly and by a short transmission pathway and thereby enables the sealing force to be steadily generated at every arbitrary location where the electric power to be fed/every arbitrary location to be sealed. Furthermore, the plurality of first pins and the plurality of first biasing members are provided along the outer circumferential part of the substrate. This configuration suppresses a load caused by the biasing force from being applied to the entire substrate. As a result, this configuration enables the seal portion to be pressed and sealed by an appropriate pressing force, while suppressing the load from being applied to the entire substrate. Furthermore, this configuration enables an appropriate sealing force to be generated along the warpage of the substrate at every arbitrary location where the electric power to be fed/every arbitrary location to be sealed.

According to a third aspect, the substrate holder of either the first aspect or the second aspect may further comprise a second plate placed relative to the first plate. The first biasing member may be placed between the first plate and the second plate such as to separate the first plate and the second plate from each other. The locking member may be locked to the locked portion of the first pin on an opposite side of the second plate to the first plate.

The configuration of this aspect enables the first biasing member to be held in a stable attitude between the first plate and the second plate and enables a stable biasing force to be applied from the first biasing member to the first plate.

According to a fourth aspect, the substrate holder of the third aspect may further comprise a second biasing member placed between the locking member and the second plate. The locking member may be biased by the second biasing member to the locked state or to the unlocked state.

At a normal lock position biased to the locked state by the second biasing member, the configuration of this aspect does not require application of any external force/energy to keep the locking member in the locked state. This configuration accordingly requires application of an external force/energy against the biasing force of the second biasing member with a view to releasing the lock only at the time of mounting and demounting the substrate, while not requiring any external force/energy to keep the locked state during holding the substrate. This achieves energy saving. At a normal release position biased to the unlocked state by the second biasing member, the configuration of this aspect does not require application of any external force/energy to release the lock.

According to a fifth aspect, the substrate holder of either the third aspect or the fourth aspect may further comprise a second pin fixed to the second plate. The locking member may include a first guide hole which the second pin is inserted in. The locking member may be guided by the second pin along a surface of the second plate to be moved between the locked state and the unlocked state.

The configuration of this aspect enables the locking member to be moved along the surface of the second plate between the locked state and the unlocked state in a stable attitude.

According to a sixth aspect, in the substrate holder of either the third aspect or the fourth aspect, the locking member may be moved along with the second plate to become closer to and away from the first plate. The first plate may include one of a third pin and a second guide hole which the third pin is inserted in, and the second plate may include the other of the third pin and the second guide hole. The first and second plates are guided by the third pin to be moved closer to and away from each other.

The configuration of this aspect enables the first plate and the second plate to approach to and separate from each other in a stable attitude.

According to a seventh aspect, in the substrate holder of any one of the first aspect to the sixth aspect, at least part of the first biasing member may be located outside of the substrate.

In the configuration of this aspect, the first biasing member is placed at a position close to a sealing location of the outer circumferential part of the substrate. This enables an appropriate biasing force to be applied directly and by a short transmission pathway to any location where the electric power is to be fed/any location to be sealed. This suppresses a load caused by the biasing force from being applied to the other part of the substrate or to the entire substrate.

According to an eighth aspect, in the substrate holder of the seventh aspect, the first biasing member may have a spring that is placed in a periphery of the at least one first pin. For example, the spring may be arranged coaxially with the first pin. An elastic element (for example, a tubular elastic element) placed in the periphery of the first pin may be used in place of the spring.

The configuration of this aspect causes the first pin and the spring that define the biasing force applied to the substrate and the seal portion to be arranged close to the seal portion and to be arranged close to each other or coaxially. This configuration effectively suppresses deformation and/or reduces a bending moment of the members between the first pin, the spring, and the seal portion.

According to a ninth aspect, in the substrate holder of the seventh aspect, the first biasing member may include an elastic element placed on an inner side of the first pin and/or an elastic element placed on an outer side of the first pin in an outward direction of the substrate. The elastic member employed may be an elastic element made of any material such as a rubber or a resin and formed in any shape such as a rod-like shape or a tubular shape. The outward direction of the substrate indicates a direction that is perpendicular to a side of the substrate or to a tangent of a periphery of the substrate and goes outward. In the case of a circular substrate, the outward direction denotes outward in a radial direction. In the case of a polygonal substrate, the outward direction denotes a direction that is perpendicular to a side and goes outward.

The configuration of this aspect causes the first pin and the elastic element that define the biasing force applied to the substrate and the seal portion to be arranged close to the seal portion and to be arranged close to each other. This configuration effectively suppresses deformation and/or reduces a bending moment of the members between the first pin, the elastic element and the seal portion. Furthermore, the configuration of providing a common elastic element for a plurality of first pins reduces the number of the components.

According to a tenth aspect, in the substrate holder of any one of the first aspect to the ninth aspect, at least part of the first biasing member may be arranged to overlap with the seal portion.

The configuration of this aspect enables the biasing force to be transmitted from the first biasing member to the seal portion more directly and by a shorter transmission pathway.

According to an eleventh aspect, in the substrate holder of any one of the first aspect to the tenth aspect, the seal member may further include a protrusion that is protruded toward the first plate on an outer side of the seal member, and the first pin may be placed on an outer side of the seal portion and on an inner side of the protrusion in an outward direction of the substrate.

The configuration of this aspect causes the seal portion and the protrusion respectively placed on the respective sides of the first pin to receive the pressing force from the first plate in the outward direction of the substrate. This configuration enables a more stable biasing force to be applied to any location where the electric power is to be fed/any location to be sealed. This establishes a more stable local seal structure, while suppressing a load caused by the biasing force from being applied to the other part of the substrate or to the entire substrate.

According to a twelfth aspect, in the substrate holder of any one of the first aspect to the eleventh aspect, the locked portion of the first pin may comprise a first locked portion configured to lock the first plate and the contact assembly in a state that a distance between the first plate and the holder body of the contact assembly is equal to a first distance; and a second locked portion configured to lock the first plate and the contact assembly in a state that the distance between the first plate and the holder body of the contact assembly is equal to a second distance that is larger than the first distance.

According to the configuration of this aspect, locking by the first locked portion enables the substrate holder to hold the substrate in the state that the substrate is appropriately sealed by the seal portion. Additionally, locking by the second locked portion enables the substrate holder without holding the substrate to be stored in the locked state without applying a load to the seal portion.

According to a thirteenth aspect, in the substrate holder of any one of the first aspect to the twelfth aspect, the contact assembly may have a plurality of contact seal modules, and each of the contact seal modules may include at least one contact and the seal member provided corresponding to the at least one contact.

According to this aspect, the seal member is divided for each group of the contacts. This configuration achieves a more local seal structure. This configuration enables the contact to be sealed more effectively by the seal portion with regard to each module. Each contact seal module may be arranged along the warpage of the substrate. This configuration enables the seal portion to be compressed by an appropriate force with regard to each contact seal module. This achieves a more local seal structure.

According to a fourteenth aspect, in the substrate holder of the thirteenth aspect, at least one first pin may be provided for each of the contact seal modules.

The configuration of this aspect enables the more appropriate biasing force to be received with regard to each contact seal module.

According to a fifteenth aspect, in the substrate holder of the thirteenth aspect, at least one first pin and at least one first biasing member may be provided for each of the contact seal modules.

The configuration of this aspect enables the more appropriate biasing force to be received with regard to each contact seal module.

According to a sixteenth aspect, the substrate holder of either the fourteenth aspect or the fifteenth aspect may further comprise the first pin placed between adjacent contact seal modules.

The configuration of this aspect places the first pin between the contact seal modules and thereby does not require any structure of receiving the first pin to be provided inside of the contact seal module. This facilitates the layout of the first pin.

According to a seventeenth aspect, in the substrate holder of any one of first aspect to the sixteenth aspect, the holder body may have a bus bar that is electrically connected with the contact.

According to this aspect, the bus bar is used as the holder body to fix the first pin. This simplifies the configuration of the substrate holder and/or reduces the size of the substrate holder.

According to an eighteenth aspect, in the substrate holder of the seventeenth aspect, the holder body may further include a third plate attached to the bus bar on a side opposite to the first plate.

The configuration of this aspect causes the bus bar to be shielded by the third plate and prevents the electric current from directly flowing from a plating solution to the bus bar. Moreover, this configuration causes the first pin to be fixed to the bus bar and the third plate and thereby further stabilizes the fixation of the first pin.

According to a nineteenth aspect, in the substrate holder of any one of the first aspect to the eighteenth aspect, the substrate may be in a polygonal shape, and the contact and the seal member may be provided on opposed two sides of the substrate.

This aspect simplifies the configuration of the substrate holder and reduces the weight of the substrate holder.

According to a twentieth aspect, there is provided a plating apparatus, which comprises the substrate holder of any one of the first aspect to the nineteenth aspect; and a plating device configured to plate a substrate held by the substrate holder. The configuration of this aspect has similar functions and advantageous effects to those of the first to the nineteenth aspects described above and can improve the plating quality.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit respective constituent elements described in the claims and the specification in a range where at least a part of the above-mentioned problem can be solved or a range where at least a part of the effect is exhibited.

The present application claims a priority to Japanese patent application No. 2019-225776 filed on Dec. 13, 2019. The entire disclosure of Japanese patent application No. 2019-225776 filed on Dec. 13, 2019, including the specification, claims, drawings and summary is incorporated herein by reference in its entirety. The entire disclosure of Japanese Unexamined Patent Publication No. 2018-40045 (Patent Document 1). Japanese Unexamined Patent Publication No. 2019-7075 (Patent Document 2), Japanese Unexamined Patent Publication No. 2008-133526 (Patent Document 3), and Japanese Unexamined Patent Publication No. 2007-46154 (Patent Document 4) including the specification, claims, drawings and summary is incorporated herein by reference in its entirety.

REFERENCE SIGNS LIST

39 plating device
100 plating apparatus
200 substrate holder
210 first holding member
211*a*, 211*b* longitudinal members
212, 213 transverse members
215 rail
216 arm
217 external connecting portion
218*a*, 218*b* bus bars
220 second holding member
230 power feed module
231 seal member
232 support plate
233 substrate contact
234 pressing plate
235 seal portion
236 through hole
237 seal portion
238 through hole
239 seal portion
240 protrusion
242 through hole
243 contact leading end
243*a* leaf electrode
250 front plate
251 through hole (female thread)
260 bus bar
263 through hole
264 projection
268 through hole
270 pin
274, 275 flanges
280 back plate
281 substrate support plate
282 shock absorber
290 float plate
291 guide pin
295 spring
297 guide pin
300 lock plate
301 base end portion
302 guide portion
303 guide groove
304 locking portion
304*a* step
305 biasing mechanism
309 spring
410, 420 elastic elements

What is claimed is:

1. A substrate holder, comprising:

a contact assembly provided with a contact configured as an electric contact to come into contact with an outer circumferential part of a first face of a substrate, a seal member provided with a seal portion configured to cover a periphery of a leading end portion of the contact and to come into contact with the first face, and a holder body configured to hold the contact and the seal member;

a first plate located on a second face side of the substrate and configured to hold the substrate between the contact assembly and the first plate;

at least one first pin rigidly fixed to the holder body of the contact assembly, extended through the first plate on outside of the substrate, and provided with a locked portion located at an opposite side of the contact assembly relative to the first plate;

a locking member placed on the opposite side of the contact assembly relative to the first plate and configured to be displaceable parallel to the first plate between a locked state and an unlocked state, the locking member engaging with the locked portion of the first pin in the locked state; and at least one first biasing member placed between the locking member and the first plate along the outer circumferential part of the substrate such as to separate the locking member and the first plate from each other and compressed between the locking member and the first plate in the locked state to bias the first plate toward the contact assembly.

2. The substrate holder according to claim 1, further comprising:

a second plate placed relative to the first plate, wherein the first biasing member is placed between the first plate and the second plate such as to separate the first plate and the second plate from each other, and the locking member is locked to the locked portion of the first pin on an opposite side of the second plate to the first plate.

3. The substrate holder according to claim 2, further comprising:

a second biasing member placed between the locking member and the second plate, wherein the locking member is biased by the second biasing member to the locked state or to the unlocked state.

4. The substrate holder according to claim 2, further comprising:

a second pin fixed to the second plate, wherein the locking member includes a first guide hole which the second pin is inserted in, and the locking member is guided by the second pin along a surface of the second plate to be moved between the locked state and the unlocked state.

5. The substrate holder according to claim 2, wherein the locking member is moved along with the second plate to become closer to and away from the first plate, the first plate includes one of a third pin and a second guide hole which the third pin is inserted in, the second plate includes the other of the third pin and the second guide hole, and the first and second plates are guided by the third pin to be moved closer to and away from each other.

6. The substrate holder according to claim 1, wherein at least part of the first biasing member is located outside of the substrate.

7. The substrate holder according to claim 6, wherein the first biasing member has a spring that is placed in a periphery of the at least one first pin.

8. The substrate holder according to claim 6, wherein the first biasing member includes an elastic element placed on an inner side of the first pin and/or an elastic element placed on an outer side of the first pin in an outward direction of the substrate.

9. The substrate holder according to claim 1, wherein at least part of the first biasing member is arranged to overlap with the seal portion.

10. The substrate holder according to claim 1, wherein the seal member further includes a protrusion that is protruded toward the first plate on an outer side of the seal member, and the first pin is placed on an outer side of the seal portion and on an inner side of the protrusion in an outward direction of the substrate.

11. The substrate holder according to claim 1, wherein the locked portion of the first pin comprises:

a first locked portion configured to lock the first plate and the contact assembly in a state that a distance between the first plate and the holder body of the contact assembly is equal to a first distance; and a second locked portion configured to lock the first plate and the contact assembly in a state that the distance between the first plate and the holder body of the contact assembly is equal to a second distance that is larger than the first distance.

12. The substrate holder according to claim 1, wherein the contact assembly has a plurality of contact seal modules, and each of the contact seal modules includes at least one contact and the seal member provided corresponding to the at least one contact.

13. The substrate holder according to claim 12, wherein at least one first pin is provided for each of the contact seal modules.

14. The substrate holder according to claim 12, wherein at least one first pin and at least one first biasing member are provided for each of the contact seal modules.

15. The substrate holder according to claim 13, further comprising the first pin placed between adjacent contact seal modules.

16. The substrate holder according to claim 1, wherein the holder body has a bus bar that is electrically connected with the contact.

17. The substrate holder according to claim 16, wherein the holder body further includes a third plate attached to the bus bar on a side opposite to the first plate.

18. The substrate holder according to claim 1, wherein the substrate is in a polygonal shape, and the contact and the seal member are provided on opposed two sides of the substrate.

19. An apparatus for plating, comprising:

the substrate holder according to claim 1; and a plating device configured to plate a substrate held by the substrate holder.

20. A substrate holder, comprising:

a contact assembly provided with a contact configured as an electric contact to come into contact with an outer circumferential part of a first face of a substrate, a seal member provided with a seal portion configured to come into contact with the first face on inside of the contact, and a holder body configured to hold the contact and the seal member;

a first plate located on a second face side of the substrate and configured to hold the substrate between the contact assembly and the first plate;

a plurality of first pins, each being rigidly fixed to the holder body of the contact assembly, extended through the first plate on outside of the substrate, and provided with a locked portion located at an opposite side of the contact assembly relative to the first plate;

a locking member placed on the opposite side of the contact assembly relative to the first plate and configured to be displaceable parallel to the first plate between a locked state and an unlocked state, the locking member engaging with the locked portion of the first pin in the locked state; and a plurality of first biasing members provided along the outer circumferential part of the substrate, placed between the locking member and the first plate such as to separate the locking member and the first plate from each other, and compressed between the locking member and the first plate in the locked state to bias the first plate toward the contact assembly.

* * * * *